US007512348B2

(12) United States Patent
Suzuki et al.

(10) Patent No.: US 7,512,348 B2
(45) Date of Patent: Mar. 31, 2009

(54) IMAGE FORMING APPARATUS WITH A TONER REPLENISHMENT FEATURE

(75) Inventors: Hideaki Suzuki, Ibaraki (JP); Yusuke Ishida, Ibaraki (JP); Kazushige Nishiyama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/313,800

(22) Filed: Dec. 22, 2005

(65) Prior Publication Data

US 2006/0159474 A1 Jul. 20, 2006

Related U.S. Application Data

(62) Division of application No. 10/935,086, filed on Sep. 8, 2004, now Pat. No. 7,010,237.

(30) Foreign Application Priority Data

Sep. 22, 2003 (JP) ..... 2003-330054
Sep. 22, 2003 (JP) ..... 2003-330057

(51) Int. Cl.
*G03G 15/08* (2006.01)

(52) U.S. Cl. ..... 399/27

(58) Field of Classification Search ..... 399/27, 399/49

See application file for complete search history.

(56) References Cited

U.S. PATENT DOCUMENTS 4,903,051 A * 2/1990 Egawa et al. ..... 347/137
5,031,123 A * 7/1991 Narukawa ..... 399/59

(Continued)

FOREIGN PATENT DOCUMENTS

CN 1218205 A 6/1999

(Continued)

OTHER PUBLICATIONS

Computer Translation of cited document JP05-066669a.*

(Continued)

*Primary Examiner*—Quana M Grainger
(74) *Attorney, Agent, or Firm*—Fitzpatrick, Cella, Harper & Scinto

(57) ABSTRACT

An image forming apparatus includes: a developing unit for developing a latent image on an image bearing member by using a developer containing toner and a carrier; and a detecting unit for detecting a density of a detection reference toner image, wherein detection results obtained by the detecting unit are employed to control a toner replenishment operation for the developing unit, and wherein, when the detection results obtained by the detecting unit is equal to or smaller than a predetermined value, a residual toner amount determination mode is performed. The residual toner amount determination mode includes: a toner replenishment step of performing an operation for replenishing toner; a detecting step of performing the detecting unit to detect the density of the detection reference toner image; and a comparison step of comparing a first detection result obtained at the detection step with a second detection result obtained by the detecting unit before said toner replenishment step is performed the first time, and for which respective performance of the steps is enabled while an image forming operation is halted, and wherein, based on the results obtained at said comparison step, whether the residual toner amount determination mode should be continued is determined.

2 Claims, 12 Drawing Sheets

U.S. PATENT DOCUMENTS

| | | | | |
|---|---|---|---|---|
| 5,655,185 | A | 8/1997 | Hori et al. | 399/138 |
| 6,029,021 | A | 2/2000 | Nishimura et al. | 399/49 |
| 6,075,954 | A | 6/2000 | Ogata | 399/60 |
| 6,173,134 | B1 | 1/2001 | Nishimura et al. | 399/58 |
| 6,501,916 | B2 | 12/2002 | Suzuki | 399/30 |
| 7,158,731 | B2 * | 1/2007 | Takuma et al. | 399/27 |
| 2004/0179856 | A1 | 9/2004 | Suzuki | 399/27 |

FOREIGN PATENT DOCUMENTS

| | | | |
|---|---|---|---|
| EP | 1253480 | A2 * | 10/2002 |
| JP | 62-299876 | | 12/1987 |
| JP | 4-066986 | | 3/1992 |
| JP | 5-66669 | | 3/1993 |
| JP | 8-202091 | | 8/1996 |
| JP | 9-80893 | A | 3/1997 |
| JP | 2001-194840 | A | 7/2001 |

OTHER PUBLICATIONS

Japanese Notification of Reason for Refusal dated Nov. 4, 2008 in Japanese Application No. 2003-330057, and an English-language translation thereof.

* cited by examiner

IMAGE FORMING APPARATUS WITH A TONER REPLENISHMENT FEATURE

CROSS-REFERENCE TO RELATED APPLICATION

This application is a divisional of application Ser. No. 10/935,086, filed Sep. 8, 2004 now U.S. Pat. No. 7,010,237.

BACKGROUND OF THE INVENTION

1. Field of the Invention

The present invention relates to an image forming apparatus, such as a copier or a laser beam printer, that employs an electrostatic recording system or an electrophotographic system.

2. Related Background Art

A two-component developing method that uses, as a developer, a mixture of a non-magnetic toner and a magnetic carrier has been widely employed for conventional electrophotographic image forming apparatuses, especially image forming apparatuses for performing chromatic color image forming. Compared with other currently proposed developing methods, the two-component developing method is superior in the stability of image quality and the durability of the apparatus. However, since as image forming is performed only toner is consumed, the supply of an appropriate toner must be replenished, as needed, and the toner density (the ratio of the weight of toner to the total weight of a developer) must be adjusted within an appropriate range. For the stabilization of image quality, it is extremely important that the toner density be adjusted within an appropriate range, and to achieve that objective, various methods have been proposed and put to practical use.

For example, a photodetecting method, an inductance detecting method, a patch detecting method, and a video counting method have been proposed and practically employed.

Above all, the patch detecting method is a method whereby the density of a reference toner image (hereinafter referred to as a patch image) formed on a photosensitive member is read using a light source, provided opposite the surface of the toner image, and a sensor, for receiving light reflected by the surface; and whereby, to adjust toner density, toner is replenished based on a value output by the sensor. Therefore, since a sensor need not be provided for each developing device, and since a cost savings can thus be realized, the patch detecting method has been widely employed.

When an image forming apparatus is employed for an extended period of time, toner supplied from a toner storage unit is consumed, so that the amount of toner remaining must constantly be monitored, and a user must be requested to replenish the supply as necessary. Conventionally, residual toner amount detecting means of a piezoelectric type, an antenna type and a photodetecting type have been proposed and have been employed. Another method is a toner presence/absence detecting method using the patch detecting method. When, for example, the detection output for the density of a patch image is equal to or smaller than a predetermined value, or when the value of a patch image density obtained after a forced toner replenishment operation has been performed is less than a predetermined value, it is determined that there is an absence of toner (for example, Japanese Patent Application Laid-Open No. H5-66669). And since only one sensor is required, both for detecting the presence/absence of toner and for controlling toner density, a special sensor for monitoring the toner supply is not required, making this is a very superior, cost efficient method.

However, using this method, a determination is made merely as to whether a value detected for patch image density is greater or smaller than a predetermined value, and it is difficult to ascertain whether toner has actually been exhausted or whether a factor other than toner density is responsible for a reduction in the patch image density. To resolve this problem, instead of the above method that employs, during normal operation, a value detected and output for the patch image density, a method that determines whether a detected output, obtained following the performance of a forced toner replenishment operation, exceeds a predetermined value can be employed to determine the presence/absence of toner. With this method, so long as there is toner remaining in the toner storage unit, the density of a patch image is absolutely increased following the forced replenishment of toner. Therefore, regardless of the state of the developer, whether toner is present or absent can correctly be ascertained.

However, when a fixed value is employed as a threshold value for determining the presence/absence of toner, the following problem has arisen: Whereas for a patch detecting operation performed during a normal toner replenishment process a reference signal value is corrected in accordance with the conditions encountered during that specific situation, when a fixed threshold value is used during an operation performed to detect the presence/absence of toner, a patch image density signal fluctuates, depending on the current situation, and the difference between the threshold and the detected value may be too large, or too small, so that the presence/absence of toner cannot correctly be determined.

Furthermore, when the environment of the image forming apparatus is changed, the γ characteristics of a developer also fluctuate, and relative to the toner density the sensitivity of the patch image density signal is also changed. Further, since the γ characteristics of the developer also change in accordance with the accumulative use period for the developer, accordingly, the sensitivity of the patch image density signal relative to the toner density is changed. As is described above, when relative to the toner density the sensitivity of the patch image density signal is changed, the amount of change in the patch image density signal varies relative to the same change in the toner density. In this case also, when the threshold value is fixed, the presence/absence of toner cannot be correctly detected.

SUMMARY OF THE INVENTION

It is, therefore, one objective of the present invention to provide an image forming apparatus that more correctly and reliably determines, by the detection of a detecting reference toner image, the presence/absence of the toner remaining in developing means.

To achieve this objective, a preferred image forming apparatus comprises:

developing means for developing a latent image on an image bearing member by using a developer containing toner and a carrier;

detecting means for detecting a density of a detection reference toner image; and control means for control a toner replenishment operation for said developing means, based on detection results obtained by the detecting means to, wherein, when the detection results obtained by the detecting means is equal to or smaller than a predetermined value, the control means performs a residual toner amount determination mode, that includes a toner replenishment step of performing an operation for replenishing toner, a detecting step of performing the detecting means to detect the density of the detection reference toner image, and a comparison step of comparing a first detection result obtained at the detection step with a second detection result obtained by the detecting means before the toner replenishment step is performed the first time, and for which repetitive performance of the steps is enabled while an image forming operation is halted, and wherein, based on the results obtained at the comparison step, the control means determines whether the residual toner amount determination mode should be continued.

Another preferred image forming apparatus comprises:

developing means for developing a latent image on an image bearing member by using a developer containing toner and a carrier;

detecting means for detecting a density of a detection reference toner image; and control means for controlling a toner replenishment operation for the developing means, based on detection results obtained by the detecting means, wherein, when the detection results obtained by the detecting means is equal to or smaller than a predetermined value, the control means performs a residual toner amount determination mode, that includes a toner replenishment step of performing a toner replenishment operation, a detection step of performing the detecting means to detect the density of the detection reference toner image, and a comparison step of comparing the results obtained at the detection step with a reference value, and for which repetitive performance of the steps is enabled while an image forming operation is halted, wherein, based on results obtained at the comparison step, the control means determines whether the residual toner amount determination mode should be continued, and wherein the control means reduces an amount of toner to be replenished, so that the amount of toner to be replenished at the second and following times in the residual toner amount determination mode is smaller than the amount of toner to be replenished at the first time in the residual toner amount determination mode.

DETAILED DESCRIPTION OF THE PREFERRED EMBODIMENTS

The preferred embodiments of the present invention will now be described while referring to the accompanying drawings.

First Embodiment

Figure 1:
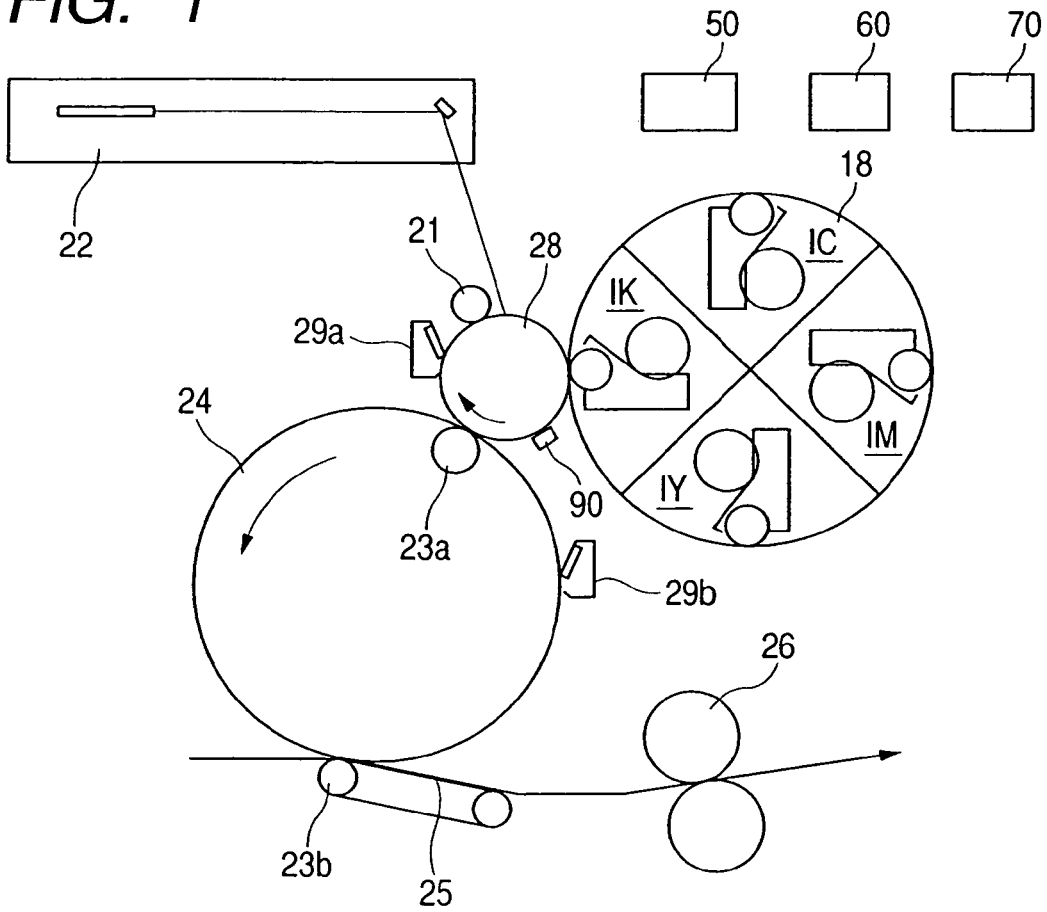
FIG. 1 is a diagram for explaining an image forming apparatus according the first to fourth embodiments of the present invention.

First, an image forming apparatus according to a first embodiment of the present invention will be described. As is shown in FIG. 1, the image forming apparatus of this embodiment is a rotating development system. A rotary member 18 includes a black developing device 1K, a yellow developing device 1Y, a magenta developing device 1M and a cyan developing device 1C, and is rotatable by a motor (not shown). To form a black toner image on a photosensitive drum 28, the black developing device 1K performs developing at a development position facing the photosensitive drum 28. Similarly, to form a yellow toner image, the rotary member 18 is rotated 90° and the yellow developing device 1Y is moved to the development position. The same process is performed to form magenta and cyan toner images.

The entire operation of the image forming apparatus in a full color image forming mode will now be explained. It should be noted that the developing device 1 is a general term for the black developing device 1K, the yellow developing device 1Y, the magenta developing device 1M and the cyan developing device 1C. In FIG. 1, an exposing device 22, such as a laser, exposes the surface of the photosensitive drum 28, which is electrified by a primary charging device 21, and forms a latent image on the photosensitive drum 28. The developing device 1 holding a predetermined toner develops the latent image on the photosensitive drum 28 and forms a toner image. The toner image is transferred to an intermediate transferring member 24 by the primary transferring bias of a primary transferring and charging device 23*a*. For the formation of a full color image, first, a black toner image is formed by the black developing device 1K and temporarily transferred to the intermediate transferring member 24. Then, the rotary member 18 is rotated 90° to move the yellow developing device 1Y to the development position, and a yellow toner image is formed on the photosensitive drum 28. The yellow toner image is then transferred to the black toner image on the intermediate transferring member 24, superimposing these images. This process is thereafter performed for the magenta developing device 1M and the cyan developing device 1C, and a predetermined full color image is formed on the intermediate transferring member 24. Thereafter, by employing the second transferring bias of a secondary transferring and charging device 23*b*, the full color image that is obtained is transferred from the intermediate transferring member 24 to a recording sheet 27 conveyed by a transfer sheet conveying belt 25. Subsequently, the image bearing sheet 27 is separated from the transfer sheet conveying belt 25 and is pressurized/heated by a fixing device 26 to obtain a permanent image. Following the completion of the primary image transfer, any toner remaining on the photosensitive drum 28 is removed by a first cleaner 29*a*, and following the completion of the secondary image transfer, any toner remaining on the intermediate transferring member 24 is removed by a second cleaner 29*b*. The image forming apparatus is thus prepared for the next image forming operation.

Figure 2:
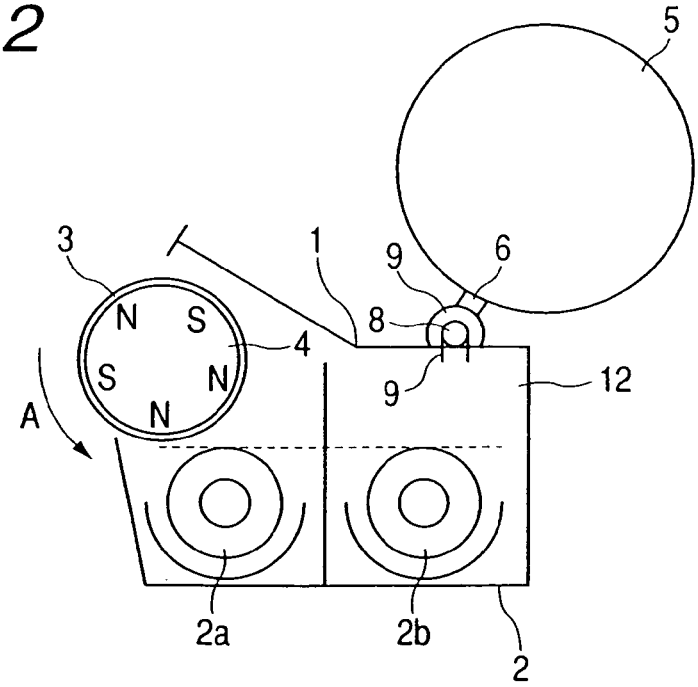
FIG. 2 is a diagram for explaining a developing device according to the first to fourth embodiments of the present invention.

A detailed description of the structure of the developing device 1 will now be given while referring to FIG. 2.

The developing device 1 holds a two-component developer formed of non-magnetic toner and magnetic carriers, and the initial density of the developer (the ratio of the weight of toner to the total weight of the developer) is adjusted to 7%. This value should be appropriately adjusted in accordance with the charge amount of toner, the size of carrier particles and the configuration of the image forming apparatus, and need not always be 7%.

The developing, open area of the developing device 1 faces the photosensitive drum 28, and in the open area, a rotatable developing sleeve 3 is arranged and is partially exposed. The developing sleeve 3 is formed of a non-magnetic material, and encloses a fixed magnet 4 used as magnetic field generation means. During the development operation, the developing sleeve 3 is rotated in a direction indicated by an arrow in FIG. 1, holds as layers the two-component developer stored in a developing container 2, and carries and supplies the developer to the development area facing the photosensitive drum 28. As a result, an electrostatic latent image is developed on the photosensitive drum 28. And after the electrostatic latent image has been developed, the developer is conveyed, as the developing sleeve 3 is rotated, and is collected in the developing container 2, for which a first agitation screw 2*a* (nearer the developing sleeve 3) and a second agitation screw 2*b* (farther from the developing sleeve 3) are provided. Within the developing container 2, the developer is stirred circularly by the first agitation screw 2*a* and the second agitation screw 2*b* and is mixed with toner supplied from a toner cartridge 5, which functions as a toner storage unit. Since all the toner cartridges 5, for black, yellow, magenta and cyan, are substantially cylindrical, they can easily be attached to or detached from the rotary member 18 and the developing devices 1.

Toner retained in the toner cartridge 5 is carried through a release port 6 to a toner supply unit 9, provided for the developing container 2, and the supply of toner to the developing container 2 is accomplished by the rotation of a toner supply member, a toner supply screw 8. The amount of toner supplied to the developing container 2 is substantially determined in accordance with the length of time the toner supply screw 8 is rotated, which is controlled by a toner supply control means 50 that will now specifically be described.

Since with each repetition of the image forming operation, toner in the developing container 2 is consumed and its density In the developer is reduced, the supply of toner must be replenished, as needed, to maintain a density that falls within a predetermined range. According to the present invention, a reference toner image is formed on the photosensitive drum 28, and a density signal, for the reference toner image, is prepared from results obtained by a density detection sensor and is compared with a previously stored initial reference signal, and based on the comparison results, the period the toner supply unit 9 is driven is controlled by the toner supply control means 50.

When the patch detection process is performed, an electrostatic latent image having a predesignated size is formed, as the reference toner image, on the photosensitive drum 28, and is developed by applying a predetermined development contrast voltage. Then, a density signal Vsig for the obtained reference toner image is prepared using the results obtained by an optical sensor 90 positioned facing the photosensitive drum 90, and its value is compared with the value of an initial reference signal Vref, previously recorded in memory. If $Vsig-Vref<0$, it is determined that the density of the patch image is low, i.e., the developer density is low, and based on the difference between Vref and Vsig, the amount of toner required for replenishment and the rotation period for the toner supply screw 9 are determined. On the other hand, when $Vsig-Vref\geqq 0$, it is determined that the density of the patch image is high, i.e., the developer density is high, and the halted state of the toner supply screw 9 is maintained.

In this embodiment, the density signal is detected for the reference toner image on the photosensitive drum 28. However, the reference toner image formed on the photosensitive drum 28 may be transferred to the intermediate transferring member 24, and the density signal for the transferred image may be detected by an optical sensor located near the intermediate transferring member 24.

A toner presence/absence detection process for this embodiment will now be described. In this embodiment, a sensor for detecting the presence/absence of toner is not provided for the toner cartridges 5 or the toner supply units 9, and a sensor used for patch detection is also for employed to detect the presence/absence of toner. With this arrangement, the costs required to provide the toner presence/absence detection sensors can be eliminated.

The value of density signal Vsig, which is detected in the patch detection mode during normal operation, is compared with a lower limit value Vlimit ($Vsig>Vlimit$), which is predesignated for the density signal, to determine whether the value of density signal Vsig is less than the lower limit value Vlimit. When the value of density signal Vsig exceeds the lower limit value Vlimit, it is assumed that sufficient toner remains in the toner cartridge 5, and difference $Vsig-Vref$ is calculated to determine the rotation period for the toner supply screw 9.

When the value of density signal Vsig is equal to or smaller than the lower limit value Vlimit, it is assumed that the amount of toner remaining in the toner cartridge 5 has been reduced. However, since the patch density may vary in accordance with a factor other than toner density, such as a triboelectricity fluctuation or a photosensitive drum 28 potential change, the danger exists that the presence/absence of toner will be determined based only on the toner density detected during a normal patch operation.

Figure 3:
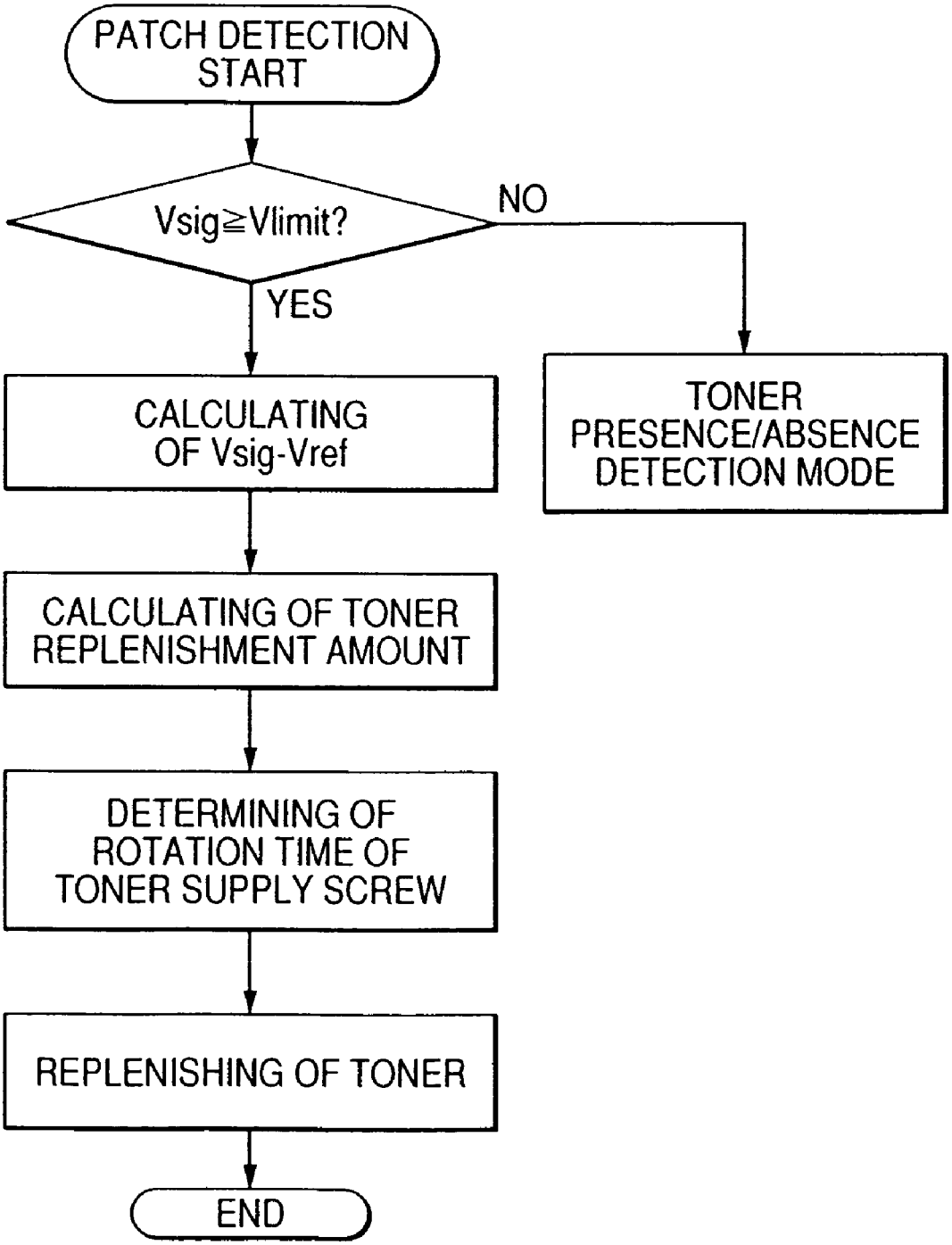
FIG. 3 is a flowchart for explaining a toner replenishment operation according to the first to fourth embodiments of the present invention.

Therefore, in this embodiment, when it is determined, by the patch detection process performed during normal operation, that the value of patch density signal Vsig is equal to or smaller than the lower limit value Vlimit, the normal image forming operation is temporarily halted, and is shifted to a special mode (a toner presence/absence detection mode) for determining the presence/absence of toner. In the toner presence/absence detection mode, the presence/absence of toner in the toner cartridge 5 is ascertained. This processing will be explained while referring to FIG. 3.

Figure 4:
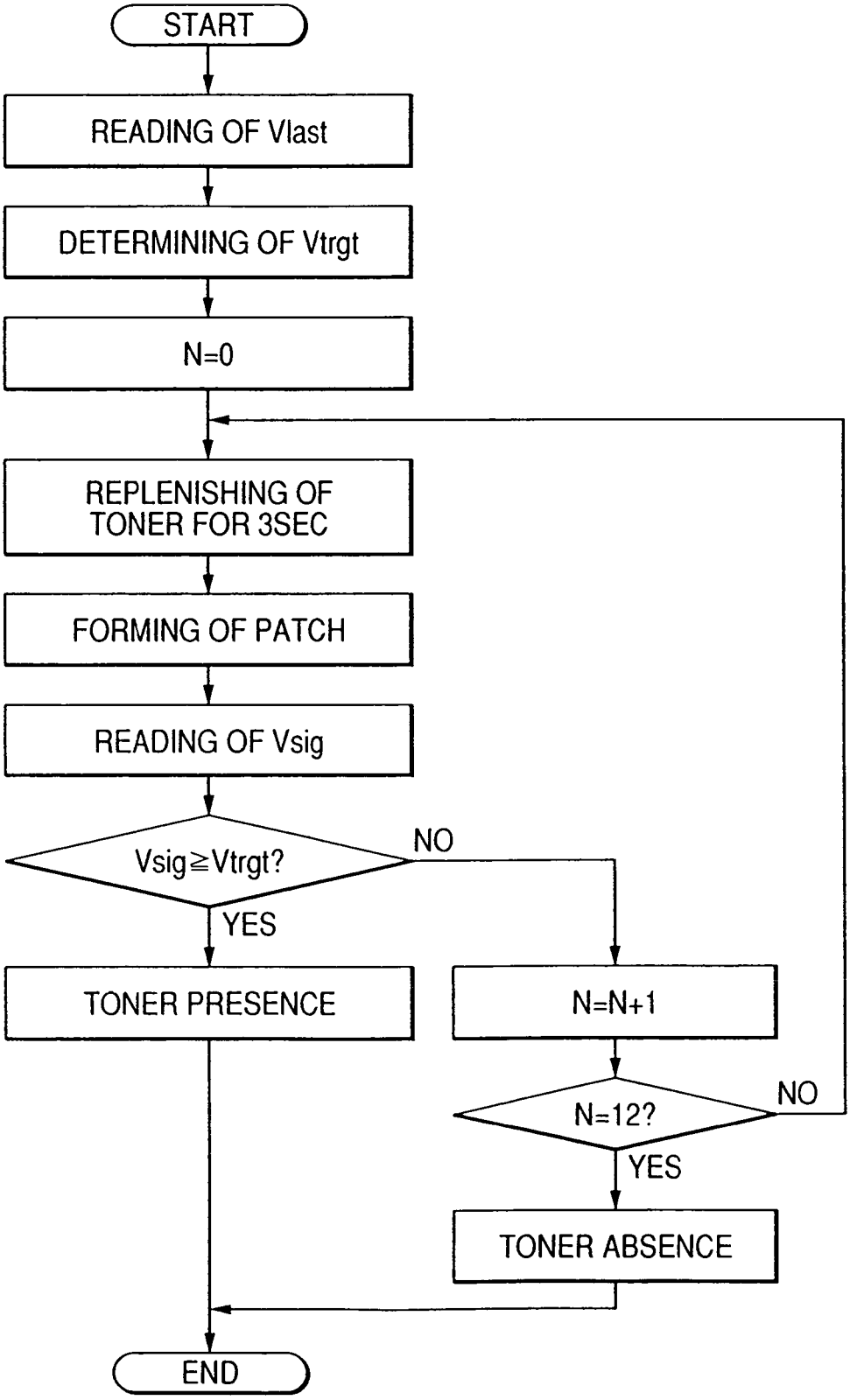
FIG. 4 is a flowchart for explaining a toner presence/absence detection mode according to the first to fourth embodiments of the present invention.

The toner presence/absence detection mode will now be specifically described while referring to FIG. 4.

When the toner presence/absence detection mode is entered, first, a patch density signal Vlast, which is obtained during normal operation immediately before the toner presence/absence detection mode is entered, is read from a non-volatile memory (not shown), and as is represented by the following expression (1), a threshold value Vtrgt, which is greater, by a predetermined amount, than signal value Vlast, is obtained in order to determine whether toner is present or absent. In expression (1), the threshold value Vtrgt is represented at a level obtained by performing a ten bit conversion of the drive voltage, 3.3 V, for a sensor.

$$Vtrgt = Vlast + 34 \quad (1)$$

The developing device 1 for determining the presence or absence of toner is shifted to the development position, and the toner supply screw 9 is rotated for three seconds to forcibly replenish toner. At the same time, a patch image is formed on the photosensitive drum 28, and the density signal Vsig is detected by the optical sensor. When Vsig≧Vtrgt, it is determined that toner is present in the toner cartridge 5, and thereafter, the toner presence/absence detection mode is terminated and the processing is returned to normal. When Vsig<Vtrgt, the toner supply screw 9 is again rotated for four seconds to replenish toner, and at the same time a patch image is formed to detect the density signal. This operation is repeated until Vsig≧Vtrgt is established. When Vsig<Vtrgt is unchanged, even though this operation is repeated twelve times, it is determined that no toner is present in the toner cartridge 5, and a message, such as "no toner", is displayed In the operating section of the main body of the image forming apparatus.

A detailed explanation will now be given for one reason that the threshold value Vtrgt, used to determine the presence/absence of toner, is determined based on the patch density signal Vlast that is obtained during normal operation immediately before the toner presence/absence detection mode is entered.

Figure 5:
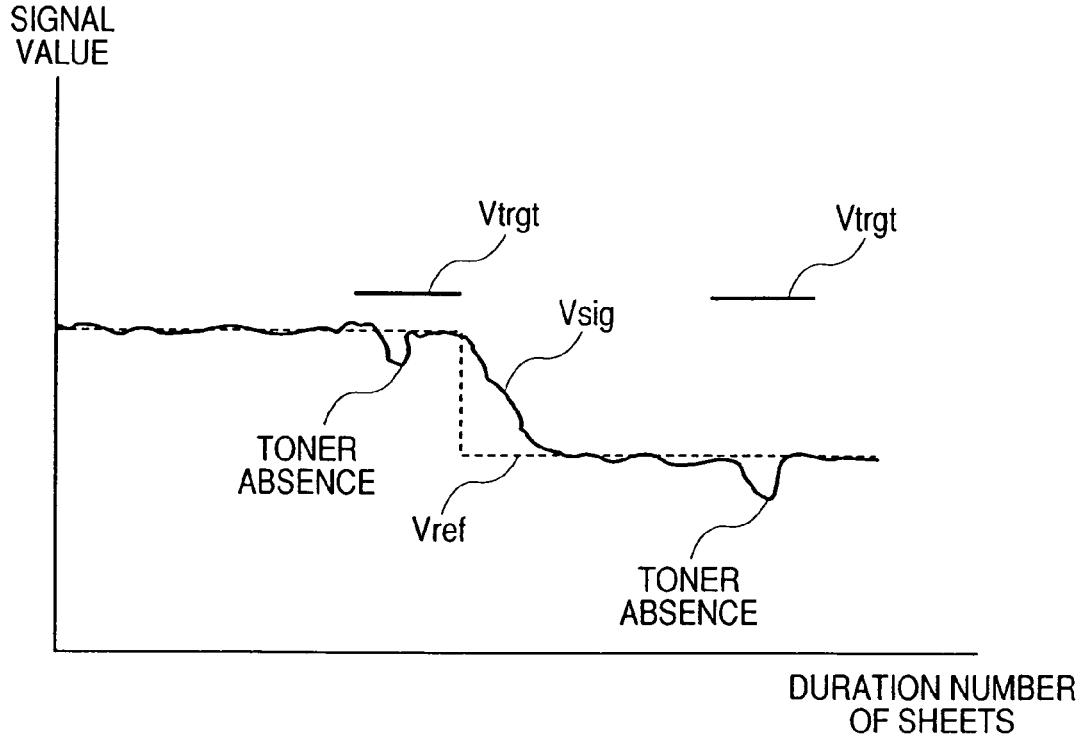
FIG. 5 is a diagram for explaining a relationship between a fixed value Vtrgt and a signal value Vsig.

For the image forming apparatus In this embodiment, which controls the amount of toner replenished based on the value detected for the patch density signal, the amount of toner replenished is controlled by detecting the density of a patch image that is formed at the development step or at the development step and the transferring step. Therefore, the density of toner in the developing device may vary greatly due to a change in the characteristics of the developer. For example, since the patch image density is reduced as the charge amount of developer is increased, the amount of toner replenished is increased, even though the actual toner density is not low, so that in the developing device, the density of the toner would be increased excessively. As means for resolving this problem, a sensor, such as an optical sensor or an inductance detection sensor, for directly detecting the density of toner in the developing device is provided for the main body of the image forming apparatus. This sensor is employed as a limiter for the toner density, and when the toner density exceeds an appropriate range, a reference signal Vref for patch detection is corrected. Then, after the reference signal Vref for patch detection is corrected, the value of patch density signal Vsig approaches the reference value Vref and the two converge, as is shown in FIG. 5, and an excessive increase in the toner density is suppressed.

However, if the threshold value Vtrgt, used for detection of the presence or absence of toner, is still maintained as fixed when the reference Vref for patch detection is corrected, a difference between the value of signal Vsig and the threshold value Vtrgt varies between when the reference signal Vref is corrected and when it is not corrected, and the presence/absence of toner may not be detected correctly. According to the example In FIG. 5, when the reference signal Vref is corrected, the difference between its value and the threshold value Vtrgt is increased, and Vsig≧Vtrgt is not obtained through the performance, a predetermined twelve times, of the forced toner replenishment operation in the toner presence/absence detection mode. As a result, though toner is present in the developing device, it may erroneously be determined that toner is absent.

Figure 6:
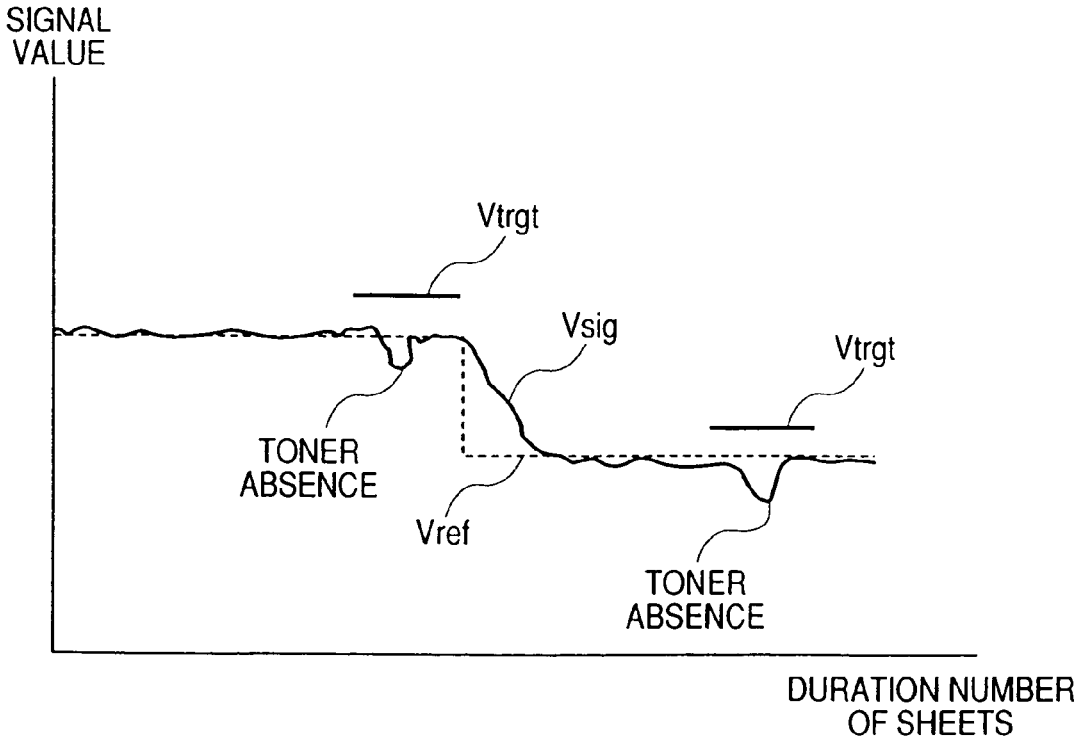
FIG. 6 is a graph for explaining a relationship between a variable value Vtrgt and a signal value Vsig.

To avoid this erroneous determination, the patch density signal Vlast, which is obtained, during the normal image forming operation, immediately before the toner presence/absence detection mode is entered, need only be employed as a reference value, a value greater, by a predetermined amount, the value of density signal Vlast prepared as the threshold value Vtrgt and used for the detection of the presence/absence of toner. As a result, as is shown in FIG. 6, an appropriate difference between Vsig and Vtrgt is maintained, and the presence/absence of toner can be determined, regardless of whether the reference signal Vref is corrected. In this case, the value of signal Vsig that is used for the determination "Vsig≧Vlimit?" in the flowchart in FIG. 3 may be employed as the patch density signal that is obtained, during the normal image forming operation, immediately before the toner presence/absence detection mode is entered.

In this embodiment, a coefficient used for calculation of the threshold value Vtrgt is designated as is represented in expression (1), and the forced toner replenishment time, in the toner presence/absence detection mode, and the number of replenishment repetitions are designated as described above. However, these numerical values are optimally set, depending on the configuration of the image forming apparatus and the developer that is to be employed.

As is described above, since the processing performed, as in this embodiment, by the image forming apparatus that employs the patch detection method to determine the presence/absence of toner in the toner storage unit, even when the reference signal for patch detection is corrected, the presence/absence of toner can be correctly detected. As a result, an image forming apparatus can be provided that will perform reliably for an extended use period of time.

Second Embodiment

The feature of a second embodiment is that a threshold value, for a patch image density signal for determining the presence/absence of toner, can be obtained based on a density signal for a first patch image that is formed in a toner presence/absence detection mode.

When the message "no toner" is displayed, a toner cartridge is exchanged for a new one, and the toner presence/absence detection mode is again started to cancel the no toner message. However, during this process, if the developer is left as it is for a long time following the display of the no toner message and before the toner presence/absence detection mode is restarted, the triboelectricity in the developer fluctuates, and the density of the first patch image formed in the toner presence/absence detection mode will be changed greatly, when compared with the density of a patch image formed during normal operation immediately before the toner presence/absence detection mode is entered. Therefore, when, as in the first embodiment, the threshold value is determined based on the patch image density signal obtained during normal operation immediately before the toner presence/absence detection mode is entered, the presence or absence of toner may not be detected correctly.

Figure 18:
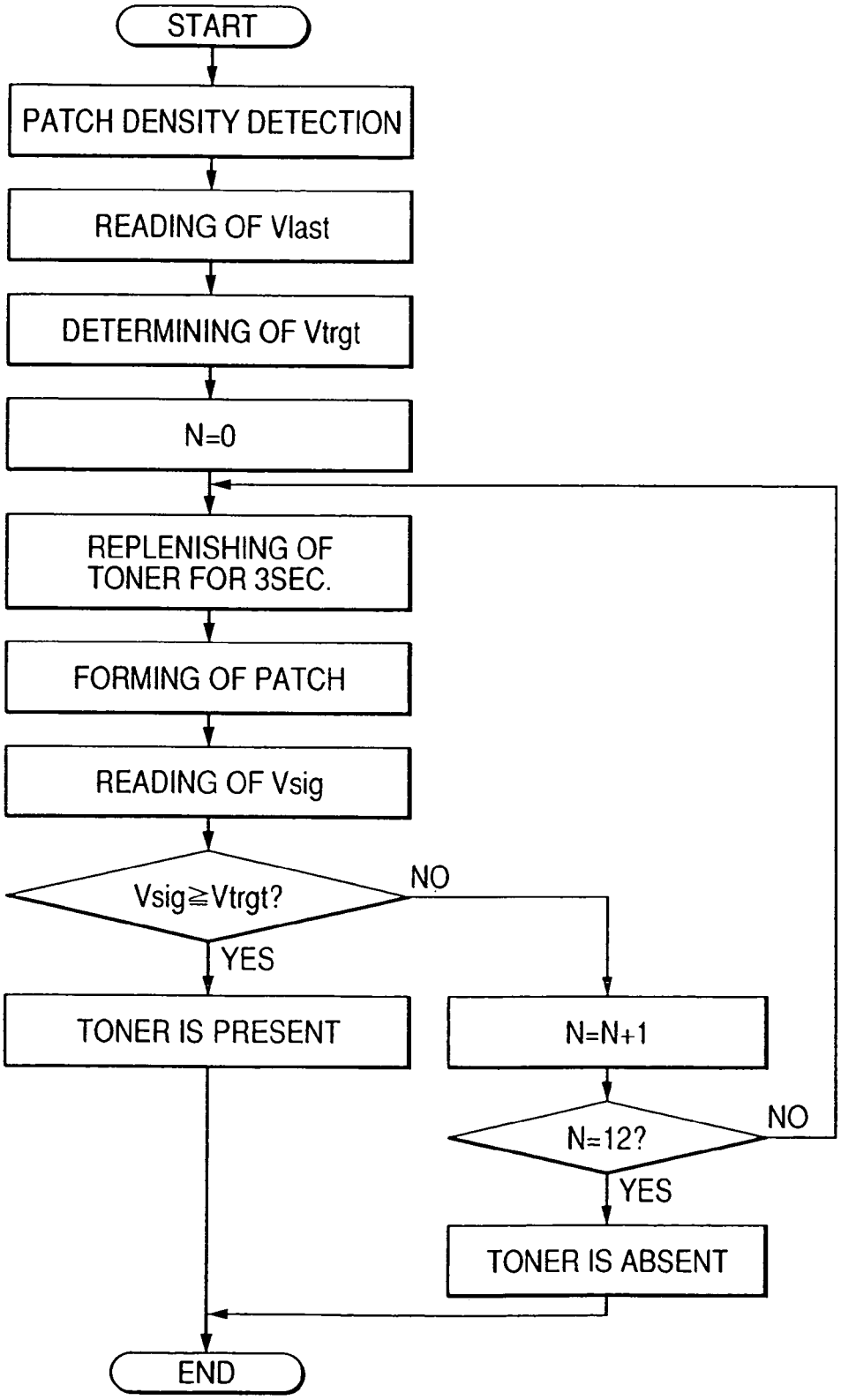
FIG. 18 is a flowchart for explaining a toner presence/absence detection mode according to the second embodiment.

Therefore, in the second embodiment, as is shown in FIG. 18, when the operating mode is shifted to the toner presence/absence detection mode, the patch density is again detected before the first toner replenishment operation is performed, and the detected value is employed as a patch density signal Vlast. Through this processing, the state immediately before the toner replenishment operation is performed can be accurately identified, and the presence or absence of toner can be detected more correctly, regardless of how long the developer is left as it is.

Third Embodiment

The feature of a third embodiment is that an environment detection sensor (temperature/humidity detection means 70) is provided to detect the temperature and humidity in the main body of the image forming apparatus, and that a threshold value used in a toner presence/absence detection mode is determined based on the absolute amount of moisture indicated by the detection results.

Figure 7:
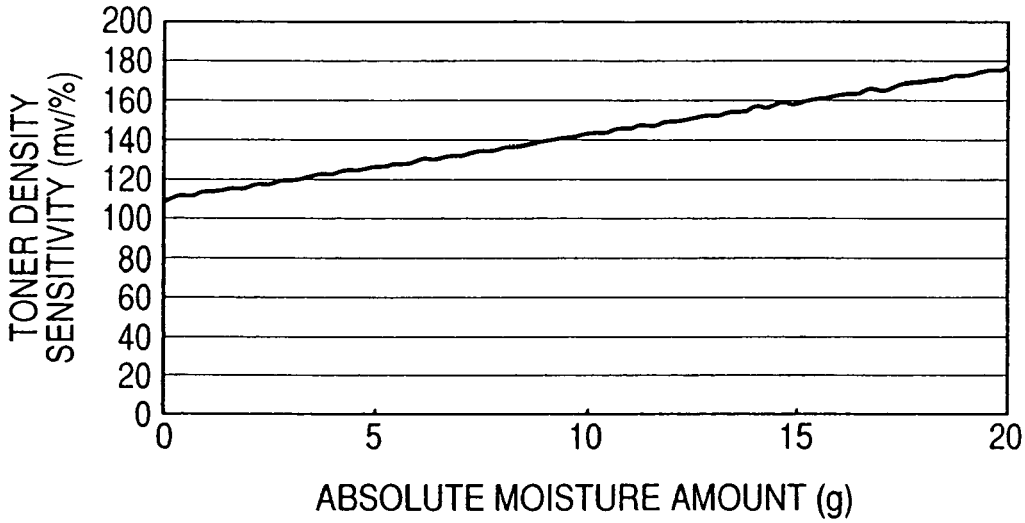
FIG. 7 is a graph for explaining a relationship between an absolute moisture amount and the toner density sensitivity of a developer.

When an environment is changed and the absolute amount of moisture in the air is altered, the γ characteristics of a developer are changed. Accordingly, relative to the toner density, the degree of change in the patch density signal, i.e., the toner density sensitivity, fluctuates. Generally, the γ characteristics tend to become more outstanding as the absolute amount of moisture rises, and as is shown in FIG. 7, the toner density sensitivity tends to increase.

Thus, when in the toner presence/absence detection mode a predetermined amount of toner is furnished to replenish the developing device 5 supply, the degree to which the patch density signal is changed varies, depending on the environment wherein the image forming apparatus is installed. For example, since toner density sensitivity is reduced in low humidity, when in such environment the toner supply is replenished by a predetermined amount, the degree of change In the patch density signal is reduced, compared with an environment wherein the humidity is high. Therefore, when a fixed threshold value is employed to determine the presence/absence of toner, more toner will be required to exceed the threshold value than when the toner supply is replenished in a high humidity environment. Therefore, an erroneous toner presence/absence determination will be made, and an excessive increase in the toner density will occur.

To resolve this problem, in this embodiment, the threshold value used in the toner presence/absence detection mode is appropriately adjusted in accordance with the toner density sensitivity, which fluctuates in consonance with the absolute amount of moisture detected. A specific control method will now be described.

In the third embodiment, as in the first embodiment, a threshold value Vtrgt is determined based on a patch image density signal Vlast obtained, during normal operation, immediately before the toner presence/absence detection mode is entered. An expression for determining the threshold value Vtrgt is defined as follows.

$$Vtrgt=Vlast+A \quad (2)$$

The coefficient "A" In expression (2) is a variable, and an appropriate value is selected in accordance with the absolute amount of moisture. The relationship between the absolute amount of moisture and the coefficient A is shown in Table 1.

TABLE 1

| Absolute amount of moisture | Coefficient A |
|---|---|
| 0 g or greater, and smaller than 3.1 g | 26 |
| 3.1 g or greater, and smaller than 5.8 g | 30 |
| 5.8 g or greater, and smaller than 10.1 g | 34 |
| 10.1 g or greater, and smaller than 15.9 g | 38 |
| 15.9 g or greater | 42 |

When the threshold value Vtrgt is determined by using expression (2), in a low humidity environment, the presence/absence of toner can be determined in accordance with a smaller change in a patch density signal. Therefore, the presence/absence of toner can be correctly detected in consonance with the toner density sensitivity of the developer. The same thing can be applied for a high humidity environment.

It should be noted that the coefficient A is not limited to the values shown in Table 1, and an optimal value can be designated, depending on the configuration of the image forming apparatus and the developer that is to be employed.

As is described above, since the threshold value used in the toner presence/absence detection mode is appropriately selected in accordance with the toner density sensitivity of the developer, which varies in consonance with the absolute amount of moisture, the detection of the presence/absence of toner can be correctly and stably performed, without being affected by the environment wherein the image forming apparatus is installed.

Fourth Embodiment

The feature of a fourth embodiment is that measuring means, for measuring a time period for using the two-component developer retained in a developing storage unit, and a nonvolatile memory, used to store a cumulative value for the use period, are provided for the image forming apparatus, and that a threshold value, used in a toner presence/absence detection mode, is determined based on a cumulative period (obtained by developer use history detection means 60), for the use of the developer, that is stored in memory.

Figure 8:
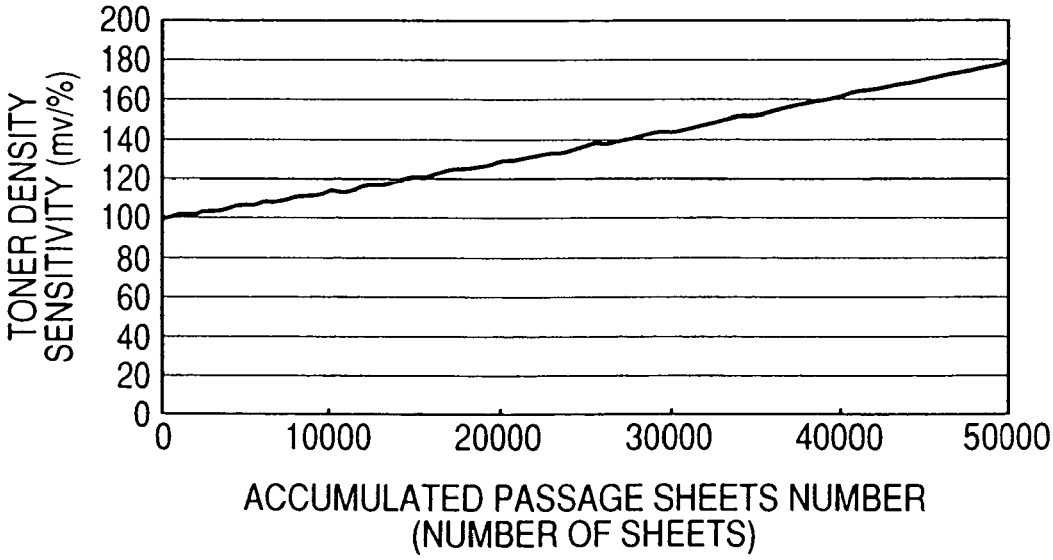
FIG. 8 is a graph showing a relationship between the number of passage sheets accumulated, which is consonant with a cumulative period for the use of a developer, and toner density sensitivity.

Since as the cumulative period for the use of a developer is increased, deterioration of the developer occurs and the γ characteristics of the developer are altered, accordingly, the amount of change in a patch density signal is relative to the toner density, i.e., the toner density sensitivity is altered. Generally, as the use period time is increased, the γ characteristics tend to become outstanding, and as is shown In FIG. 8, the toner density sensitivity tends to be increased.

Then, when in the toner presence/absence detection mode a predetermined amount of toner is used to replenish the developing device 1, changes in the patch density signal will differ, depending on how long the developer has been used. For example, for a developer that has been used for an extended period and has suffered considerable, cumulative deterioration, the toner density sensitivity is high, and when to replenish the toner a predetermined amount is added, the degree of change in the patch density signal will be greater than in the initial state of the developer. In this case, when a fixed threshold value is maintained for determining the presence/absence of toner, a toner presence determination made when the toner density has changed only slightly would tend to be erroneous.

To resolve this problem, in this embodiment, the threshold value used in the toner presence/absence detection mode is properly changed in accordance with the toner density sensitivity, which fluctuates in accordance with the cumulative period for the use of the developer. A specific control method will now be explained.

In the fourth embodiment, as in the first embodiment, a threshold value Vtrgt is determined based on a patch image density signal Vlast obtained, during normal operation, immediately before the toner presence/absence detection mode is entered. An expression for determining the threshold value Vtrgt is defined as follows.

$$Vtrgt = Vlast + B \quad (3)$$

The coefficient B in expression (3) is a variable, and an appropriate value is selected in accordance with the cumulative period for the use of the developer. The period for the use of the developer is obtained by counting the number of sheets that have been processed. In another method for measuring the period for the use of the developer, the period for rotation of the developing sleeve 3 or the period for rotation of the agitation screw 2*a* or 2*b* is counted, and an appropriate method is selected, depending on the case. The relationship between the accumulated number of sheets that have been passed and the coefficient B is shown in Table 2.

TABLE 2

| The cumulative number of sheets processed | Coefficient B |
|---|---|
| 0 or greater, and fewer than 10000 | 30 |
| 10000 or greater, and fewer than 20000 | 33 |
| 20000 or greater, and fewer than 30000 | 36 |
| 30000 or greater, and fewer than 4,0000 | 39 |
| 40000 or greater | 42 |

When the threshold value Vtrgt is determined using expression (3), the presence/absence of toner can be correctly detected, consequent with the deterioration of the developer.

It should be noted that the coefficient B is not limited to the values in Table 2, and an optimal value can be selected, depending on the configuration of the image forming apparatus and the developer that is employed.

As is described above, since for use in the toner presence/absence detection mode, an appropriate threshold value is selected in consonance with the toner density sensitivity of a developer for which its deterioration accords with its cumulative period of use, the presence/absence of toner can be correctly and stably detected, regardless of the deterioration of the developer.

Fifth Embodiment

Figure 9:
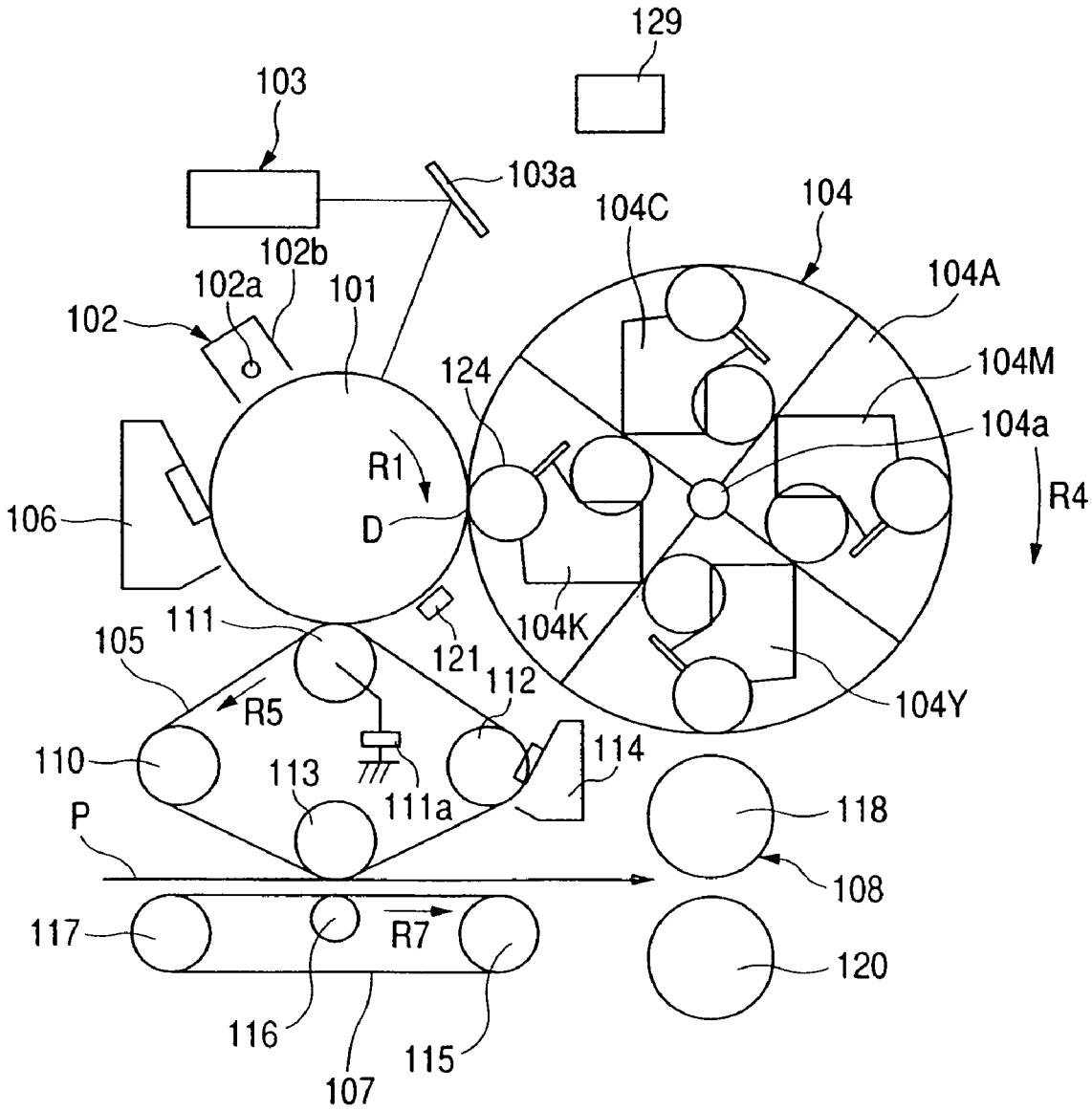
FIG. 9 is a specific, vertical cross-sectional view of the schematic configuration of an image forming apparatus according to a fifth embodiment of the present invention.

FIG. 9 is a schematic diagram showing the configuration of an image forming apparatus according to a fifth embodiment of the present invention. The image forming apparatus shown in FIG. 9 is an electrophotographic, full color printer that uses four colors.

The configuration of the printer (hereinafter referred to as the image forming apparatus) will now be described while referring to FIG. 9.

The image forming apparatus in FIG. 9 comprises a drum-shaped, electrophotographic, photosensitive member (hereinafter referred to as a photosensitive drum) 101 that functions as an image bearing member. The photosensitive drum 101 is supported so it is rotatable in the direction indicated by an arrow R1. Around the periphery of the photosensitive drum 101, arranged in order from upstream in its rotational direction, are a primary charging device (charging means) 102, an exposure apparatus (exposure means) 103, a developing apparatus (developing means) 104, an intermediate transferring belt 105 and a cleaning apparatus (cleaning means) 106. Further, positioned under the intermediate transferring belt 105 is a transferring and conveying belt 107, downstream of which, in the direction in which recording material P is conveyed (a direction indicated by an arrow A), is a fixing apparatus (fixing means) 108.

Figure 10:
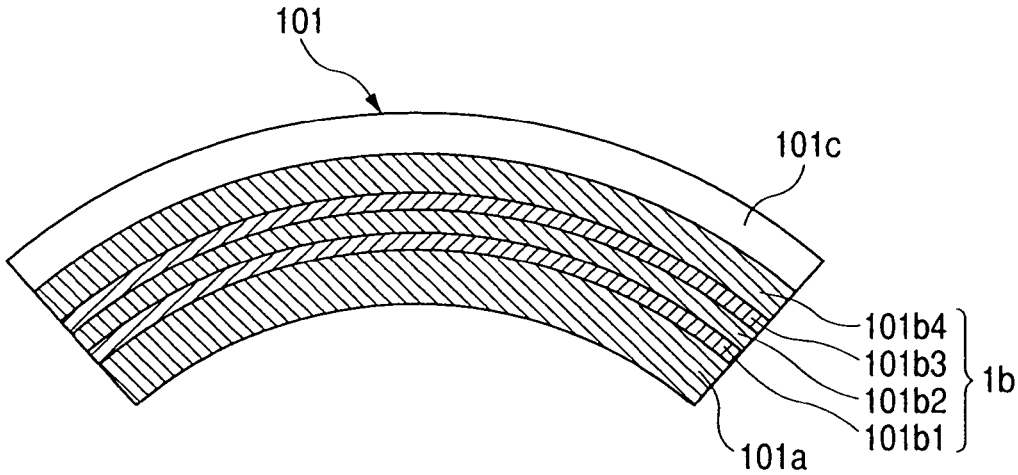
FIG. 10 is a specific, vertical cross-sectional view of the structure of the layers on a photosensitive drum.

In this embodiment, the photosensitive drum 101 has a diameter of 60 mm. As is shown in FIG. 10, to obtain the photosensitive drum 101, a photosensitive layer 101*b*, of a common organic photoconductive (OPC) material, is formed on the outer surface of a grounded, conductive drum base 101*a*, of aluminum, and a protective layer (OCL) 101*c*, having a superior abrasion resistance, is deposited on the photosensitive layer 101*b*. The photosensitive layer 101*b* is in turn formed of four layers, a subbing layer (CPL) 101*b*l, an injection prevention layer (UCL) 101*b*2, a charge generation layer (CGL) 101*b*3 and a charge transportation layer (CTL) 101*b*4. The photosensitive layer 101*b* is normally an insulating member, and is characterized in that it becomes conductive when irradiated by light having a specific wavelength. This occurs because positive holes (electron pairs) are generated in the charge generation layer 101*b*3 by light irradiation, and serve as charge carriers. The charge generation layer 101*b*3 is made of polycarbonate, wherein 0.2 μm of a phthalocyanine compound has been dispersed, and the charge transportation layer 101*b*4 is made of polycarbonate, wherein 25 μm of a hydrazone compound has been dispersed. The photosensitive drum 101 is rotated by driving means (not shown) at a predetermined processing speed (a peripheral velocity) in the direction indicated by the arrow R1.

In this embodiment, a corona discharging device of a scorotron type is employed as the primary charging device 102. The corona discharging device is formed by partially enclosing a discharge wire 102*a* with a metal shield 102*b* that is open toward the photosensitive drum 101.

A laser scanner for turning on or off a laser beam In accordance with image data is employed as the exposure device 103 in this embodiment. A laser beam emitted by the exposure apparatus 103 irradiates the surface of the electrified photosensitive drum 101 through a reflection mirror. Through this process, charges are removed/ from the irradiated portion and an electrostatic latent image is formed.

The developing apparatus 104 for this embodiment employs a rotating development method, and includes: a rotary member 104A, which is rotated by a motor (not shown) at a shaft 104*a* in the direction indicated by an arrow R4; and four developing devices mounted on the rotary member 4A, i.e., black, yellow, magenta and cyan developing devices 104K, 104Y, 104M and 104C. To form a black developer image (toner image) on the photosensitive drum 101, the black developing device 104K performs the development process at a development position D near the photosensitive drum 101. Similarly, to form a yellow toner image, the rotary member 104A is rotated 90° to move the yellow developing device 104Y to the development position D for the development process. The same operation is performed to form magenta and cyan toner images. In the following explanation, unless a specific color is designated, the developing device 104 is referred to.

The intermediate transferring belt 105 is extended around a drive roller 110, a primary transferring roller (a primary transferring and charging device) 111, a coupled roller 112 and a secondary transferring opposed roller 113, and as the drive roller 110 is rotated, is moved in the direction indicated by an arrow R5. Further, a belt cleaner 114 contacts the intermediate transferring belt 105. The transferring and conveying belt 107 is extended around a drive roller 115, a secondary transferring roller 116 and a coupled roller 117, and as the drive roller 115 is rotated, is moved in the direction indicated by an arrow R7. The transferring roller 108 includes a fixing roller 118, incorporating a heater (not shown), and a pressure roller 120, which contacts the fixing roller 118 from below.

The operation of the thus arranged image forming apparatus will now be described.

In FIG. 9, the exposure apparatus 103 exposes the surface of the photosensitive drum 101 that has been electrified by the primary charging device 102, and forms an electrostatic latent image on the photosensitive drum 101. The developing device 104, holding a predetermined color developer (toner), attaches the toner to the electrostatic latent image, forming a toner image on the photosensitive drum 101. A primary transferring bias application power source 111*a* applies a primary transferring bias to the primary transferring roller 111, and the toner image is transferred to the intermediate transferring belt 105.

For full-color image suing four colors, first, a black toner image is formed on the photosensitive drum by the black developing device 104, and is transferred to the intermediate transferring belt 105. After the primary transfer had been completed, toner remaining on the surface of photosensitive drum 101 (residual toner) is removed by the cleaning apparatus 106. Then, the rotary member 104A is rotated at 90°, and the yellow developing device 104Y is moved to the development position D and forms a yellow toner image on the photosensitive drum 101. Thereafter, as the primary image transfer, the yellow toner image is transferred to the intermediate transferring belt 105 and is superimposed on the black toner image thereon.

This operation is then performed for the magenta developing device 104M and the cyan developing device 104C, so that four, differently colored toner images are superimposed on the intermediate transferring belt 105. Thereafter, a second transferring bias is applied to the second transferring roller 116, and as a secondary image transfer, the four differently-colored toner images borne by the intermediate transferring belt 105 are collectively transferred to the recording material P that is conveyed along the transferring and conveying belt 107.

The recording material P bearing the toner image is separated from the transferring and conveying belt 107, and is heated and pressurized by the fixing roller 118 of the fixing apparatus 108 and the pressure roller 120. As a result, the toner image is fixed to the surface of the recording material P, and a four-color image is obtained. After the secondary image transfer has been completed, toner remaining on the intermediate transferring belt 105 (residual toner) is removed by the belt cleaner 114.

For monochrome image forming, an electrostatic latent image formed on the photosensitive drum 101 is developed by a developing device 104 that holds a predetermined color toner. The obtained toner image is then transferred to the intermediate transfer belt 105 and, immediately afterwards, is transferred to the recording material P. Thereafter, the recording material P bearing the toner image is separated from the transferring and conveying belt 107, and is heated and pressurized by the fixing apparatus 108 to fix the toner image on the surface.

In this embodiment, an image density detection sensor 121 is located downstream of the development position D and upstream of the primary transferring roller 111 in the rotational direction of the photosensitive drum 101, so that the image density detection sensor 121 faces the surface of the photosensitive drum 101.

Figure 11:
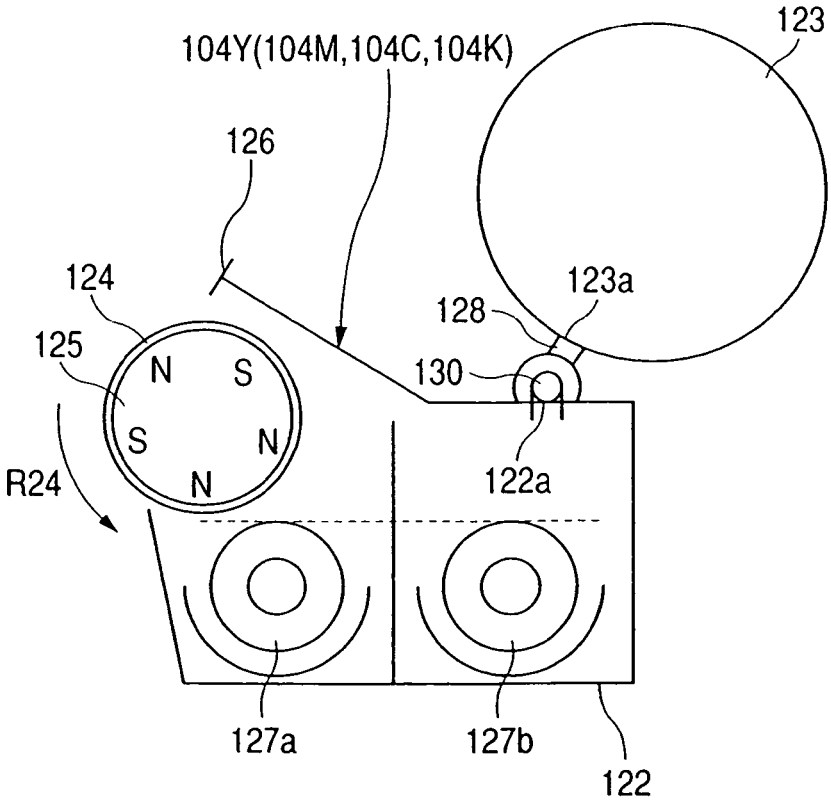
FIG. 11 is a vertical cross-sectional view of the structure of a developing device.

While referring to FIG. 11, an explanation will now be given for the developing devices 104Y, 104M, 104C and 104K, in FIG. 9, that are provided for the individual colors and are mounted to the rotary member 104A. For each developing device 104, a two component developer containing non-magnetic toner, about 8% by weight, and magnetic carriers is retained in a developer container 122. The toner density should be appropriately adjusted in accordance with the charge amount of toner, which need not always be 8% by weight, the carrier particle size, and the configuration of the image forming apparatus.

When image development has exhausted the toner in developer, it is replenished by obtaining an appropriate amount of toner from a toner container 123, one of which is detachably positioned in the vicinity of each developing device 104 in the rotary member 104A.

When a developing device 104 is moved to the development position D, a development opening faces the photosensitive drum 101, and a rotatable developing sleeve 124 is arranged so that it is partially exposed at the development opening.

A fixed magnet 125, which is magnetic field generation means, is enclosed in the developing sleeve 124. During the development process, the developing sleeve 124, made of a non-magnetic material, is rotated in the direction indicated by an arrow R24 in FIG. 11, i.e., rotated downward in the direction consonant with the gravitational force in the vicinity of the development opening. Then, the developing sleeve 124 carries to the development opening the two-component developer in the developing container 122, which constitutes the developing device 104, while holding layers of the developer. In this manner, the developer is supplied to the development position D facing the photosensitive drum 101, and an electrostatic latent image on the photosensitive drum 101 is developed.

In order to maintain an appropriate amount of developer to be carried to the development opening, a regulation blade (developer regulation member) 126 is located upstream of the development opening, in the rotational direction of the developing sleeve 124, and faces the developing sleeve 124. Control of the thickness of the developer laid on the developing sleeve 124 is provided by the regulation blade 126.

After the electrostatic latent image has been developed, residual developer is carried forward as the developing sleeve 24 is rotated, and is collected at the developer container 122. In the developer container 122, as developer agitation and carrying means, a first circulating screw 127*a* and a second circulating screw 127*b* are respectively arranged near and further from the developing sleeve 124. These screws 127*a* and 127*b* circulate and agitate and mix the developer in the developer container 122. It should be noted that in this embodiment, as shown in FIG. 11, the first circulating screw 127*a* circulates the developer from the rear to the front while the second circulating screw 127*b* circulates the developer from the front to the rear.

As the image formation number of sheets (the number of copies) is increased, the toner in the two component developer is consumed, and an amount of toner equivalent to the amount consumed is carried along a replenishment path 128, leading from a developer supply port 123*a* in the toner container 123 to a developer replenishment port 122*a* in the developer container 122, to replenish the supply of toner in the developer container 122. The toner is stored in the developer container 122, upstream in the direction in which the developer is circulated by the second circulating screw 127*b*, and is then agitated and mixed with developer already present in the developer container 122 and developer carried there by the first circulating screw 127*a*, following the development process. The thus agitated developer is then transported to the first circulating screw 127*a*, and is again supplied to the developing sleeve 124. Located along the replenishment path 128 is a replenishment screw (toner replenishment means) 130. The rotation time for the replenishment screw 130 is controlled by a CPU 129, the control means, and the amount of toner required to replenish the developing device 104 is adjusted in accordance with the rotation time.

A toner patch detection method for the embodiment will now be explained.

When the image forming apparatus is initially installed, first, a reference toner image (hereinafter referred to as a patch image) is formed under image forming conditions based on a predesignated environment table, stored in backup memory, wherein temperature and humidity information and corresponding processing procedures are entered, i.e., values are predesignated for processing conditions such as exposure intensity and developing and transfer biases. That is, the electrified photosensitive drum 101 is exposed to a laser beam, and a patch latent image is formed on the photosensitive drum 101 and developed to obtain a patch image. This method is called a digital patch image method. As another method, instead of using a laser bean to expose the photosensitive drum 101, i.e., instead of emitting light at an exposure level of zero, the contrast potential for a patch latent image may be obtained based on a potential difference between a developing bias and the potential of the photosensitive drum 101 (the potential of a portion that is electrified by the primary charging device 102 but is not exposed by the exposing apparatus 103), and the patch latent image may be developed to obtain a patch image. This is called an analog patch image method. The amount of replenishing toner transported from the toner container 123 to the developer container 122 is controlled by the CPU 129, so that a predesignated target patch signal value is equal to the density of a patch image used for toner replenishment, which is detected during the density control process that is performed thereafter, i.e., the target patch signal value is equal to the sensor output value.

In this embodiment, a latent image formed by digital exposure is called a digital latent image, and an image obtained by developing the digital latent image is called a digital image. To distinguish between these, a latent image to form a patch image without performing the above described exposure is called an analog latent image, and an image obtained by developing the analog latent image is called an analog image. In the following explanation, these terms are employed as needed.

According to the digital patch image method, however, the initial state of the characteristics of the photosensitive drum 101, especially its photosensitivity, is sometimes changed because of deterioration, the result of employment over an extended period of time, and environmental changes. Therefore, a difference exists between an actual potential that is obtained by exposing the photosensitive drum 101 to the laser beam emitted by the exposure apparatus 103, and a potential that should be obtained in the initial state, and because of this potential difference, the density of an image formed on the photosensitive drum 101 is at variance with a predetermined value. When toner is replenished In accordance with a image density value arrived at by including this error, the density of the toner in the developing device 104 will fall outside a desired range, and due to the change in the image density and toner fogging, an image fault will occur.

Furthermore, in order to reduce manufacturing costs and size, a photosensitive member potential measurement sensor, which is an expensive part having a highly specialized function, is not provided, and the amount of replenishing toner is adjusted based only on a patch image used for toner replenishment. Therefore, variances in the density of the developer in the developing device 104 are especially increased, as is the load imposed on developer, so that a barrier, such as the frequent occurrence of abnormal or fogged images, and a reduction in the service life of the developer, may occur.

In this embodiment, in order to eliminate variances in the potential of a laser irradiated portion of the photosensitive drum 101, which are caused by changes in the photosensitivity characteristics of the photosensitive drum 101, an analog patch formation method is employed. According to this method, a patch latent image for toner replenishment is formed at a stable potential without laser exposure being performed, and is developed to obtain a patch image (reference toner image).

As is described above, the rotation time for the replenishment screw 130 is controlled by the CPU 129, and the amount of toner supplied for replenishing the developing device 104 is adjusted In accordance with the rotation time. Toner supply control means for controlling the rotation time will now be specifically described.

Since as the image forming operation is repeated, toner in the developer container 122 is consumed and the toner density in the developer is reduced, it is preferable that the toner density be adjusted within a desired range by toner replenishment, as needed. A system according to this invention employs both first toner supply control means, for controlling the rotation time for the toner replenishment screw 130 based on a video count value for an image density signal included, for example, in an image data signal for a document copy, and second toner supply control means, for forming a standard toner image (a reference toner image) on the photosensitive drum to detect the density signal of the reference toner image using a density detection sensor, for comparing the density signal value with a pre-stored initial reference signal value, and for employing the comparison results to correct the driving period for the toner supply unit, which is determined by the first toner supply control means.

According to this system, a video counting method is mainly employed to control the toner density. According to the video counting method, the level of a signal output by an image signal processing circuit is obtained for each pixel, and the number of count values accumulated is the equivalent of the pixels for the document size. In this manner, the video count value for one sheet of the document is obtained (e.g., the maximum video count value for one sheet of size A4 is 3884×106 at 400 dpi and 256 gradations). The video count value corresponds to the predicted amount of toner that will be consumed, and an appropriate rotation time for the replenishment screw 130 is determined based on a conversion table representing the relationship between the video count value and the rotation time for the toner replenishment screw 130. In accordance with the thus determined rotation time, toner is replenished.

For this embodiment, the rotation time for the toner replenishment screw 130 is selected only from among values integer times a predetermined time unit (unit block replenishment).

Figure 12:
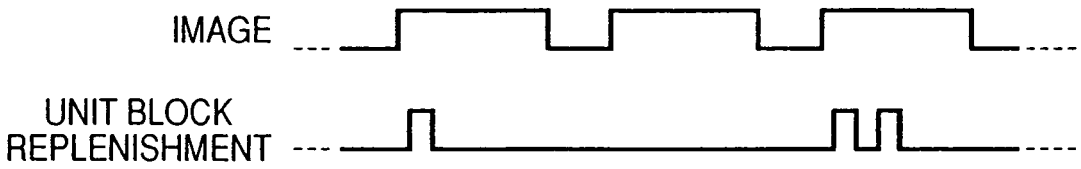
FIG. 12 is a diagram for explaining unit block replenishment according to the fifth embodiment.

In this embodiment, the rotation time for the toner replenishment screw 130 for each unit block is set at 0.3 seconds, and the rotation time for the toner replenishment screw 130 for one image is set at 0.3 seconds, or an integer times this value. A specific toner replenishment state is shown in FIG. 12.

Figure 13:
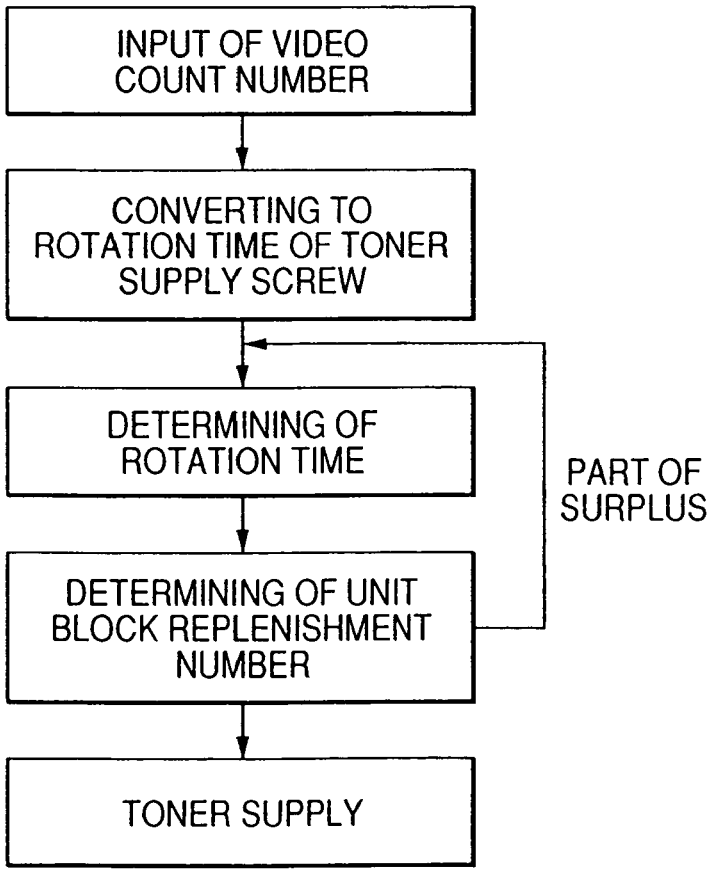
FIG. 13 is a flowchart for explaining a toner presence/absence detection operation using a video counting method according to the fifth embodiment.

When, for example, In accordance with the video count value, a rotation time of 0.42 seconds is obtained from the conversion table for the toner replenishment screw 130, and only one unit block is to be replenished for one image during the next image forming operation (the rotation time for the toner replenishment screw 130 is 0.3 seconds). The remaining rotation time, 0.12 seconds, for the toner replenishment screw 130 is stored as part of a surplus, and is added to the rotation time that is obtained based on the succeeding video count value. This processing is shown in FIG. 13.

When the rotation time for the toner replenishment screw 130 is limited only to values an integer times the predetermined unit time, as one advantage, the amount of toner replenished at one time can be stabilized. When a video count value is small, the rotation time obtained for the toner replenishment screw 130 and that is based on this is very much reduced. The short rotation time more greatly affects the rising time and the trailing time for the drive motor that drives the toner replenishment screw 130, and the amount of toner replenished is not stabilized. Therefore, as in this embodiment, when a constant rotation time is maintained for the toner replenishment screw 130, the amount of toner replenished can be stabilized.

According to the video counting method, when the actual amount of toner consumption differs from the predicted amount, the density of the developer is gradually shifted away from the appropriate range. Therefore, it is preferable that the amount of toner replenished be corrected by using a patch detection method (hereinafter referred to as a patch detection mode) at predetermined intervals (each time the image forming operation has been performed a predetermined number of times). In this embodiment, a predetermined interval is every fifty sheets for a document having a small size (e.g., an A4 portrait document).

Figure 14:
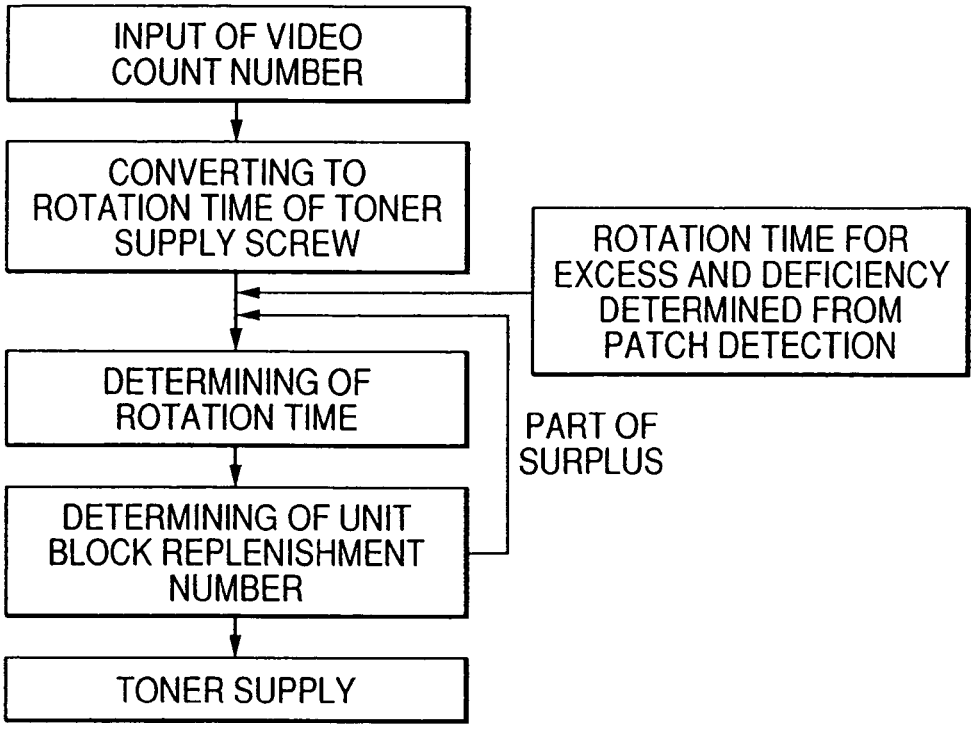
FIG. 14 is a flowchart for the toner replenishment processing that employs a video counting method and a patch detection method according to the fifth embodiment.

When the image formation number of sheets reaches fifty and the operating timing for the patch detection mode arrives, an electrostatic latent image is formed on the photosensitive drum 101 for a reference toner image having predetermined dimensions, and is developed by applying a predetermined development contrast voltage. A density signal Vsig for the obtained reference toner image is detected by an optical sensor, which is positioned facing the photosensitive drum 101, and its value is compared with an initial reference signal Vref that was previously stored in memory. When $Vsig-Vref<0$, it is ascertained that the density of a patch image is low, i.e., that the density of the developer is low. The amount of toner required for replenishment and a corresponding rotation time for the toner replenishment screw 130 are determined in accordance with the difference between Vref and Vsig, and the amount of toner required is corrected by adding the rotation time to a rotation time that has been determined using the video counting method. When $Vsig-Vref\geqq 0$, it is ascertained that the density of a patch image is high, i.e., that the density of the developer is high. The amount of unnecessary toner and a corresponding halted time for the toner replenishment screw 130 are determined in accordance with the difference between Vref and Vsig, and the amount of toner required for replenishment is corrected by subtracting the halted time from a rotation time that is determined using the video counting method. Through this control process, the toner density difference can be corrected. Processing performed by using both the video counting method and the patch detection method is shown in FIG. 14.

In this embodiment, the density signal for the reference toner image is detected on the photosensitive drum 101. However, the reference toner image formed on the photosensitive drum 101 may be transferred to the intermediate transferring member 105 and detected after the transfer has been completed, and the density signal Vsig may be detected by the optical sensor positioned near the intermediate transferring member 105.

Figure 15:
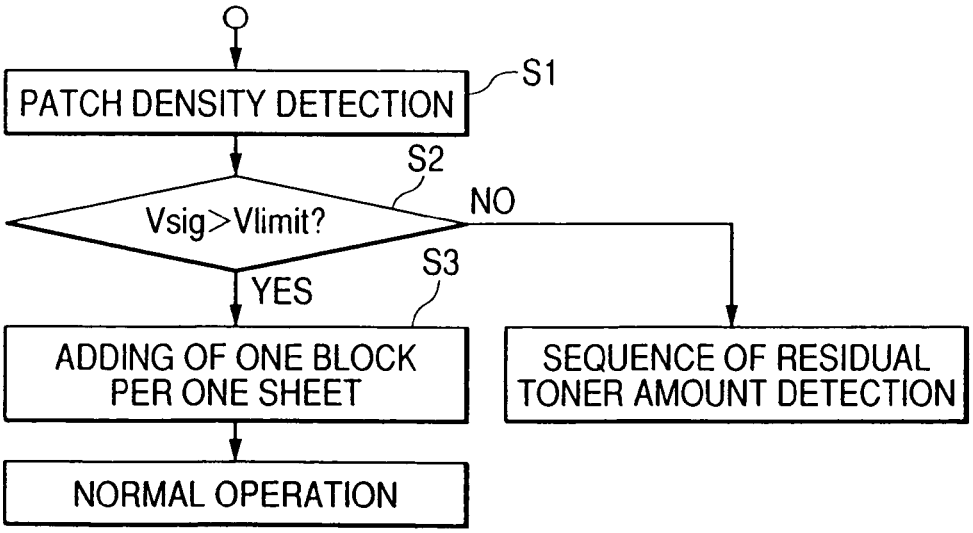
FIG. 15 is a flowchart showing a toner presence/absence detection operation according to the fifth embodiment.

When based on the detection results In the patch detection mode the rotation time for the toner replenishment screw 130 is to be increased, i.e., when the number of unit blocks to be replenished is to be increased, as is shown in FIG. 15, only one block is added for each image. That is, when based on the detection results obtained in the patch detection mode ten unit blocks to be replenished are to be added, instead of adding all these blocks, one block is added for each image to complete a correction using ten or more sheets. Through this processing, a sudden rise in the toner density in the developing device 104 and the occurrence of a fogged image and a broken line image can be prevented.

The toner presence/absence detection process for this embodiment will now be described. In this embodiment, sensors for detecting the presence/absence of toner are not provided for the toner cartridges (toner containers) 123, and the sensor output used for patch detection is also employed by the CPU 129 to detect or determine the presence/absence of toner. When the CPU 129 determines that the amount of toner remaining in the toner cartridge 123 is so small that succeeding image forming cannot be performed, the CPU 129 inhibits the image forming process. That is, the CPU 129 employs the detected density of the patch image to determine not only the presence/absence of toner in the toner cartridge 123, but also to determine whether the image forming should be continued. In the configuration of this embodiment, wherein toner cartridges are provided for the image forming apparatus for toner replenishment as needed, the detected density of the patch image is employed to determine the presence/absence of toner in the toner cartridge 123. However, a toner hopper having a large capacity may be provided for the image forming apparatus, and the presence/absence of toner in the toner hopper may be determined based on the detected density of the patch image. In this case, toner from the toner cartridge is used to replenish the toner hopper.

Through the above described operation, the cost required for the toner presence/absence detection sensor can be eliminated. FIG. 15 is a flowchart showing the toner presence/absence detection operation.

The value of density signal Vsig detected in the patch detection mode (S1) is compared with a predesignated lower limit value Vlimit for a density signal (S2) to determine whether the value of density signal Vsig exceeds the lower limit value Vlimit. When the value of density signal Vsig exceeds the lower limit value Vlimit, the CPU 129 determines that a sufficient amount of toner is present in the toner cartridge 123, and the amount of toner to be used for replenishment is corrected to add one block for each image as described above (S3). When the value of density signal Vsig is equal to or smaller than the lower limit value, the CPU 129 determines that the amount of toner remaining in the toner cartridge 123 is reduced, and enters a residual toner amount detection mode. Then, when the CPU 129 is shifted to this mode, the CPU 129 inhibits image forming, and displays a message to this effect on the liquid crystal display of the image forming apparatus, or transmits a message to this effect through a network cable to a personal computer, for example, that is connected to the image forming apparatus.

Figure 16:
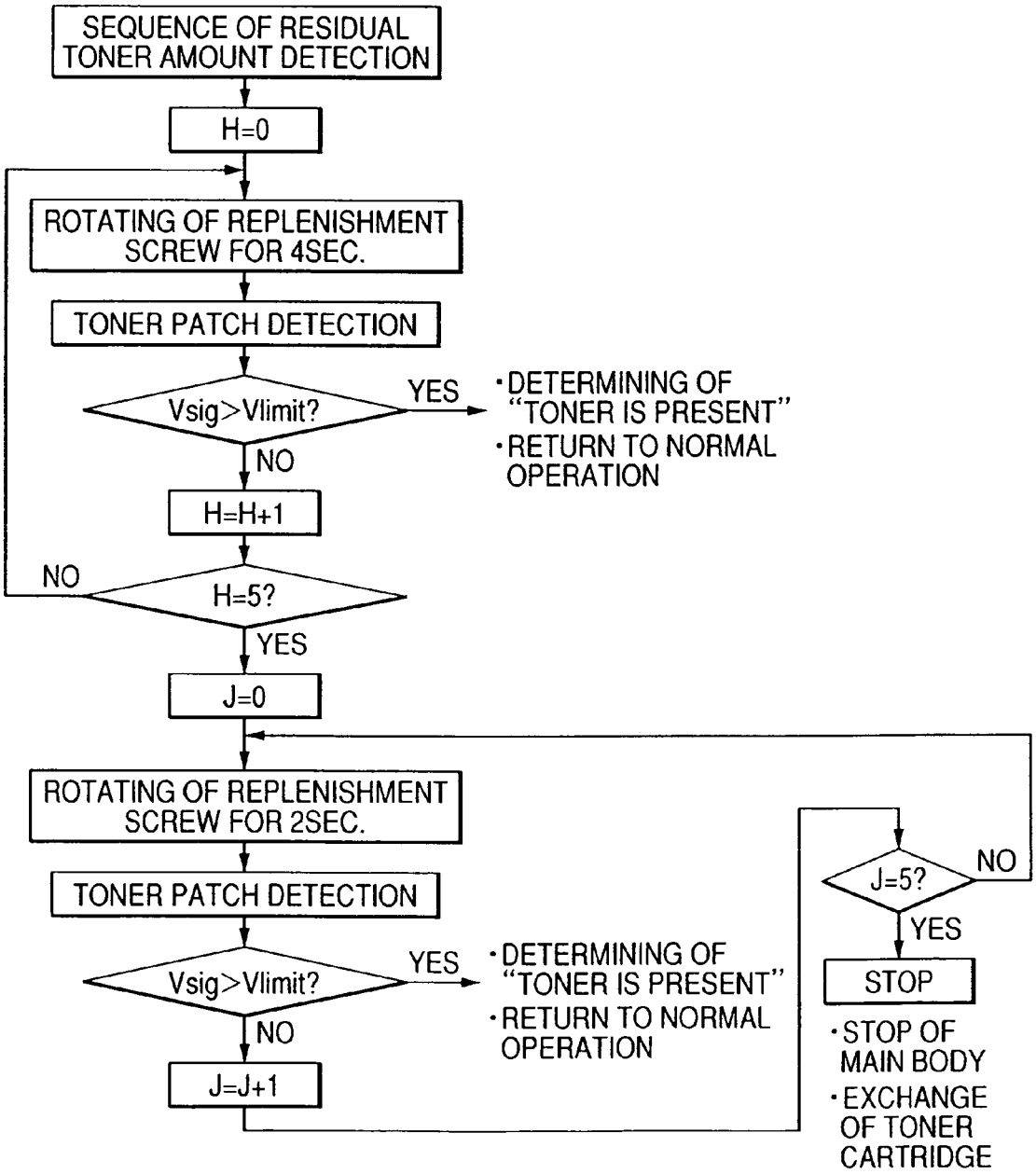
FIG. 16 is a flowchart for explaining a residual toner amount detection sequence according to the fifth embodiment.

The residual toner amount detection mode for this embodiment will now be described while referring to FIG. 16.

First, the rotary member 104A is rotated to move the developing device 104 entered in the residual toner amount detection mode.

The toner replenishment screw 130 is rotated four seconds (a period that does not depend on the output of a patch sensor) to forcibly perform the toner replenishment operation, and at the same time, the developing device 104 is idly rotated four seconds, i.e., agitates the developer. Thereafter, a toner patch image is formed, and the density signal Vsig for this image is detected by a sensor. When the detected signal value exceeds the lower limit value Vlimit, the residual toner amount detection mode is terminated and the image forming inhibited state is shifted to the image forming enabled state.

When the value of density signal Vsig still exceeds the lower limit value Vlimit, the toner replenishment screw 130 is again rotated four seconds, and the developer 104 is also idly rotated four seconds. Then, a series of steps for forming a toner patch image is again performed, and the density signal Vsig for this image is detected by the sensor. When the detected signal value is equal to or smaller than the lower limit value Vlimit, the above described operation is repeated a predetermined number of times (H) (five times in this embodiment).

When the operation is repeated the predetermined number of times (five times) and the detected signal value is still equal to or smaller than below the lower limit value Vlimit, the forced replenishment operation is performed for a period shorter than the period for the preceding forced replenishment operation, i.e., two seconds. When the signal value detected at this time is equal to or smaller than the lower limit value Vlimit, this forced replenishment operation is repeated a predetermined number of times (J) (five times in this embodiment).

When the thus detected signal value is still smaller than the lower limit value Vlimit, the CPU 129 determines that there is no toner, and outputs an exchange toner cartridges notification, i.e., outputs a signal requesting an exchange.

This signal is transmitted to the liquid crystal display that is provided as display means at the upper portion of the main body of the image forming apparatus. When the image forming apparatus is connected to a personal computer through a network, and is functioning as a printer, the signal may be output to the personal computer through the network.

As is described above, and as is shown in FIG. 16, the forced replenishment operation is performed five times for four seconds each, and sequentially, is performed five times for two seconds each. During each replenishment operation, the developer 104 is idly rotated for four seconds.

As described for this embodiment, in the residual toner amount detection mode, the time (the amount of toner replenished) wherein the toner replenishment screw 130 is driven for each forced replenishment operation is changed in accordance with the repetition count for the step, so that the driving time at the succeeding step is shorter than the driving time at the initial step.

That is, since the toner density is lowered when the residual toner amount detection mode is entered, the amount of toner replenished one time is increased to quickly raise the toner density. When the toner density is increased, to a degree, the amount of toner replenished one time is reduced so as to gradually raise the toner density.

As is described above, in the residual toner amount detection mode, since the amount of toner replenished during one forced replenishment operation is changed during the detection sequence series, the presence/absence of toner can be determined within a short period of time, erroneous detection of the presence/absence of the toner can be prevented, and a sudden increase in the toner density can be avoided.

If a large amount of toner is replenished during one forced replenishment operation at the beginning of the residual toner amount detection mode, the toner density is sharply increased, and various problems, such as toner dispersion, image fogging and image density defects, will occur.

Further, if a small amount of toner is replenished during one forced replenishment operation, a sharp increase in the toner density can be avoided, while more time will be required to raise the toner density and there will be frequent downtimes.

When the CPU 129 determines there is no toner, a new, full toner cartridge is loaded into the image forming apparatus. Then, the CPU 129 again enters the residual toner amount detection mode and performs the steps and operations described above to determine the presence/absence of toner. In this case, since the length of the period extending from the toner cartridge exchange to the image forming enabled state can be greatly reduced, erroneous detection of the presence/absence of toner can be prevented, and sharp increases in toner density can be avoided. Furthermore, an image forming failure, which occurs when an image is formed on the first sheet following the recovery to the image forming enabled state, can be prevented.

As is described above in this embodiment, an image forming apparatus can be provided that employs the toner patch detection method to determine, within a short period of time, the presence/absence of toner in a toner cartridge, that prevents erroneous detections of the presence/absence of toner, and that avoids sharp increases in toner density.

Sixth Embodiment

A sixth embodiment will now be described. Since the image forming processing performed in this embodiment is substantially the same as that in the fifth embodiment, no further explanation for that will be given.

In the fifth embodiment, a patch image was formed for each time the forced replenishment operation was repeated in the residual toner amount detection mode. However, in the first half of the residual toner amount detection sequence (corresponding to the operation for the first embodiment wherein toner replenishment performed for four seconds was repeated five times), the operation for the forcible replenishment of a large amount of toner was performed in order to quickly recover the toner density, to a degree. Therefore, very rarely does the patch density reach a desired value (Vlimit) during this period. Therefore, in the sixth embodiment, in the residual toner amount detection sequence, first, the forced replenishment operation is performed without a toner patch image being detected, and after the toner density has been recovered, to a degree, the forced replenishment operation is repeated, while the toner patch detection is also performed. This processing will now be described in detail while referring to FIG. 17.

First, a rotary member 104A is rotated to move a developing device 104 that has entered the residual toner amount detection mode. Then, a toner replenishment screw 130 is rotated for twelve seconds to forcibly replenish toner, while the developing device 104 is also idly rotated for twelve seconds. During this period, toner patch detection is not performed.

Figure 17:
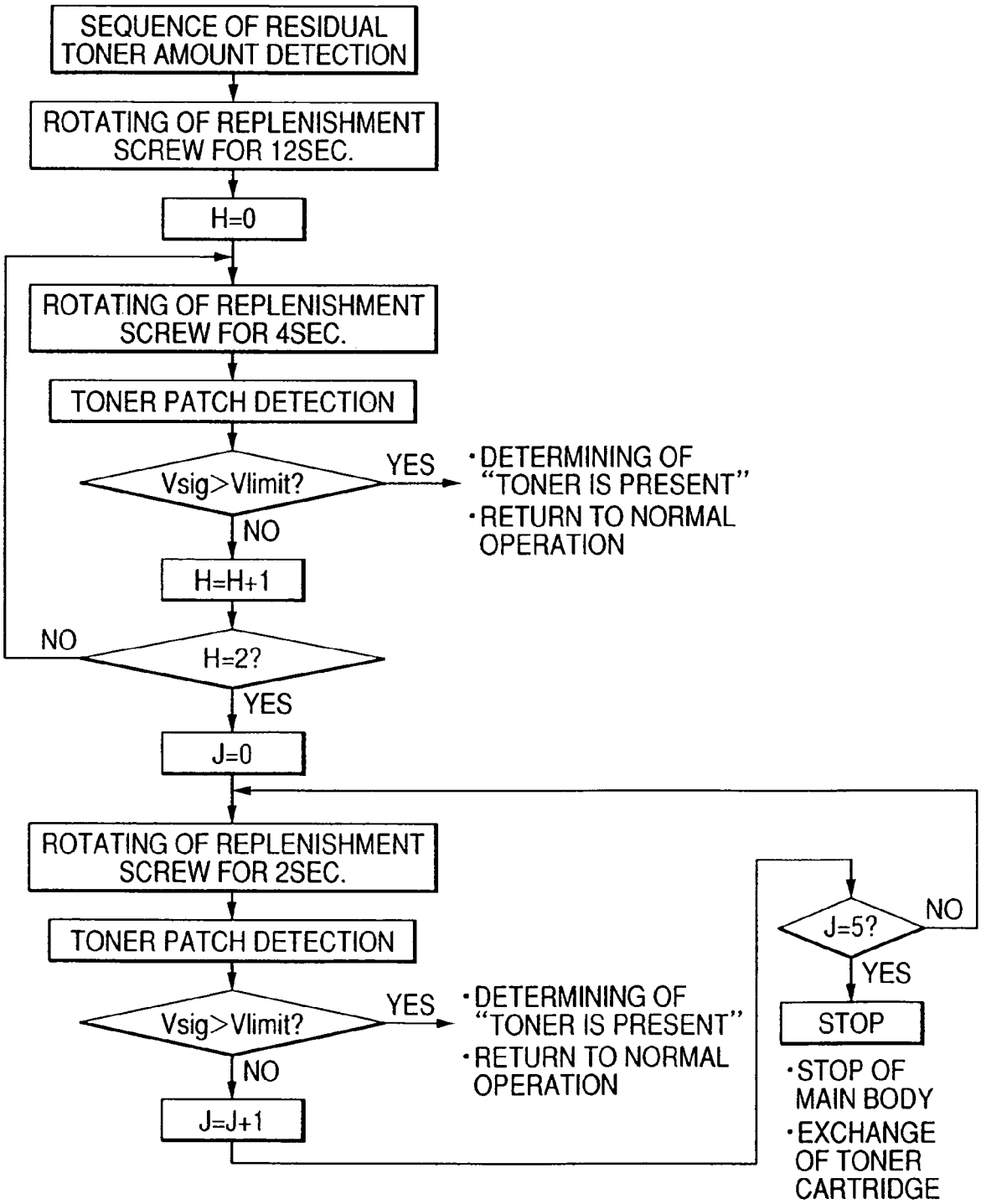
FIG. 17 is a flowchart for explaining a residual toner amount detection sequence according to a sixth embodiment of the present invention.

Thereafter, referring to FIG. 17, the forced toner replenishment operation is performed for four seconds, and toner patch detection is performed. When the detected signal value exceeds a lower limit value Vlimit for a density signal, the residual toner amount detection mode is terminated and the image forming enabled state is set.

When the detected patch signal value is equal to or smaller than the lower limit value Vlimit, the above operation is repeated a predetermined number of times (J) (twice in this embodiment).

When the operation is repeated the predetermined number of times (twice), and the detected signal value is still equal to or smaller than the lower value limit Vlimit, another forced replenishment operation is performed for a shorter period than the one above, i.e., for two seconds. When the signal value detected thereafter is equal to or smaller than the lower limit value Vlimit, this operation is repeated a predetermined number of times (J) (five times in this embodiment). When the signal value detected at this time is still equal to or smaller than the lower limit value Vlimit, it is determined that toner is absent, and a toner cartridge notification is output (a signal requesting the exchange is output).

As is described above, first, In the residual toner amount detection sequence, a forced replenishment operation is performed without a toner patch detection being performing, and after the toner density has been recovered, to a degree, the forced replenishment operation is repeated, while toner patch detection is performed. Therefore, the performance of unnecessary toner patch detection processes can be eliminated. And as a result, the amount of toner consumed during the toner patch detection process is reduced, as is the period during which image forming is inhibited (the period wherein the operating mode is shifted to the residual toner amount detection mode), i.e., downtime can also be reduced.

Seventh Embodiment

A seventh embodiment will now be described. Since the image forming process performed for this embodiment is substantially the same as that for the first embodiment, no further explanation for it will be given.

It is generally known that during the last period in the service life of a developer the charging function performed by a carrier is reduced because of deterioration.

In this case, wherein, for example, absence of toner is determined and a new, full toner cartridge is loaded, toner replenishment using the forced replenishment operation after the residual toner amount detection mode has been completed is not satisfactorily electrified, and sometimes, the fluctuation of image density occurs.

Therefore, in this embodiment, when the presence of toner is determined in the residual toner amount detection mode, as in the fifth embodiment and the sixth embodiment, a developing device that performed the process in the residual toner amount detection mode is idly rotated for thirty seconds after the residual toner amount detection mode is terminated. Through this process, when in the last period of the service life of the developer a large amount of toner is replenished in the residual toner amount detection mode, the toner replenished is satisfactorily agitated with the developer, especially the carriers, and friction charging is appropriately performed. As a result, fluctuation of the image density does not occur.

This application claims priority from Japanese 25 Patent Application Nos. 2003-330054 filed Sep. 22, 2003 and 2003-330057 filed Sep. 22, 2003, which are hereby incorporated reference herein.

What is claimed is:

1. An image forming apparatus comprising:

a developing device for developing an electrostatic image on an image bearing member using a developer containing a toner and a carrier;

a detection device for detecting a density of a detection toner image; and a controller for controlling a toner replenishment operation to said developing device on the basis of a result detected by said detection device, wherein, when a result detected by said detection device becomes equal to or smaller than a predetermined value, said controller performs a residual toner amount detection mode while interrupting an imaging forming operation, wherein, in the residual toner amount detection mode, there are performed:

a first step of performing the toner replenishment operation; and a second step of, after said first step, forming a toner patch by said developing device, and detecting said toner patch by said detection device;

wherein said controller performs said residual toner amount detection mode again if the result detected by said detection device in said second step is equal to or smaller than the predetermined value, and terminates said residual toner amount detection mode if the result detected by said detection device in said second step is larger than the predetermined value, and wherein, when the residual toner amount detection mode is performed a plurality of times, said controller performs a replenishment control in such a manner that a period of time for the toner replenishment operation during an early phase mode of the plurality of residual toner amount detection modes is longer than a period of time for the toner replenishment operation during a late phase mode, of the plurality of residual toner amount detection modes, after the early phase mode.

2. An image forming apparatus according to claim 1, wherein said controller notifies an absence of toner, if the result detected by said detection device in said second step is equal to or smaller than the reference value after said residual toner amount detection mode is repeated a predetermined number of times.

* * * * *